US006344312B1

(12) United States Patent
Goto

(10) Patent No.: US 6,344,312 B1
(45) Date of Patent: Feb. 5, 2002

(54) HEAT DEVELOPABLE PHOTOSENSITIVE MATERIAL

(75) Inventor: Takahiro Goto, Minami-ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/500,574

(22) Filed: Feb. 10, 2000

(30) Foreign Application Priority Data

Feb. 10, 1999 (JP) ..... 11-033241

(51) Int. Cl.[7] ..... G03C 1/498

(52) U.S. Cl. ..... 430/619; 430/531; 430/567; 430/569; 430/617; 430/619

(58) Field of Search ..... 430/619, 617, 430/567, 531, 640, 569

(56) References Cited

U.S. PATENT DOCUMENTS 4,797,354 A * 1/1989 Saitou et al. ..... 430/567

5,637,449 A * 6/1997 Harring et al. ..... 430/619

FOREIGN PATENT DOCUMENTS

| | | |
|---|---|---|
| EP | 0600543 B1 | 3/1999 |
| JP | 61284757 | 12/1986 |

* cited by examiner

*Primary Examiner*—Thorl Chea
(74) *Attorney, Agent, or Firm*—Birch, Stewart, Kolasch & Birch, LLP

(57) ABSTRACT

The present application discloses a heat developable photosensitive material having on a support a non-photosensitive silver salt, a photosensitive silver halide, and a binder, which has a layer formed by coating a coating composition comprising an emulsion containing both of the photosensitive silver halide and a low molecular weight gelatin having a molecular weight of 500 to 60,000. The heat developable photosensitive material provides excellent photographic properties such as low fog, high Dmax, high sensitivity, and the like, as well as good coating surface.

11 Claims, 1 Drawing Sheet

HEAT DEVELOPABLE PHOTOSENSITIVE MATERIAL

FIELD OF THE INVENTION

This invention relates to a heat developable photosensitive material and, more particularly, to a heat developable photosensitive material for scanners of image setters suitable for photomechanical processes. More specifically, this invention relates to a heat developable photosensitive material for photomechanical processes obtainable of images less subject to fog and having a high Dmax (maximum density).

BACKGROUND OF THE INVENTION

A large number of photosensitive materials having a photosensitive layer on a support for forming images upon imagewise exposure have been known. Among them, as a simplified system for rendering preservation of environments and image forming means, a technology for forming images by heat development is exemplified.

In recent years, reduction of the amount of waste processing solutions is strongly demanded in the field of photomechanical processes from the standpoint of environmental protection and space savings. To cope with this, techniques are needed in relation to photosensitive heat developable materials for use in photomechanical processes, which can be effectively exposed by a laser scanner or laser image setter and can form clear black images having high resolution and sharpness. Such heat developable photosensitive materials can provide to customers a heat development processing system, without use of solution-type processing chemicals. That is simpler and free from incurring environmental destruction.

Methods for forming an image by heat development are described, for example, in U.S. Pat. Nos. 3,152,904 and 3,457,075 and D. Morgan and B. Shely, Imaging Processes and Materials, "Thermally Processed Silver Systems" A, 8th ed., page 2, compiled by Sturge, V. Walworth and A. Shepp, Neblette (1969). The photosensitive material used contains a light-insensitive silver source (e.g., organic silver salt) capable of reduction, a photocatalyst (e.g., silver halide) in a catalytic activity amount, and a reducing agent for silver, which are usually dispersed in a reducing agent for silver, which are usually dispersed in an organic binder matrix. This photosensitive material is stable at room temperature. However, when it is heated at a high temperature (e.g. 80° C. or higher) after the exposure, silver is produced through an oxidation-reduction reaction between the silver source (which functions as an oxidizing agent) capable of reduction and the reducing agent. The oxidation-reduction reaction is accelerated by the catalytic action of a latent image generated upon exposure. The silver produced by the reaction of the silver salt capable of reduction in the exposure region provides a black image and this presents a contrast to the non-exposure region. Thus, an image is formed.

The heat developable photosensitive materials have been known previously, but in most of those, the photosensitive layer is formed by coating a coating composition having a solvent of an organic solvent such as toluene, methyl ethyl ketone (MEK), methanol, and the like. Use of such organic solvents as a solvent not only adversely affects human bodies during manufacturing processes but also is disadvantageous in term of costs due to recycling the solvents.

To cope with this, a method has been considered in which a photosensitive layer (hereinafter referred also to as "aqueous photosensitive layer") is formed using a coating composition of a water solvent not having the above problem.

For example, Japanese Unexamined Patent Publication (KOKAI) Showa (hereinafter referred to as "JP-A-") Nos. 49-52,626 and 53-116,144, and the set forth an example that gelatin is used as a binder. Also, JP-A-50-151,138 sets forth an example that a polyvinyl alcohol is used as a binder.

In JP-A-60-28,737, an example that gelatin and polyvinyl alcohol are used together is described. In addition, as another example other than the above examples, JP-A-58-28,737 sets forth an example of photosensitive layer that a water-soluble polyvinyl acetal is used as a binder.

If such a binder is used, the photosensitive layer can be formed in use of a coating composition with a water solvent, and as for photosensitive silver halide, it is advantageous to add prescribed materials according to a conventional method.

However, if ordinary gelatin having a molecular weight of about 100,000 is used for dispersion state turns into a bad state in a coating composition containing the organic silver salt and may be agglutinated, thereby obtaining only products having considerably diminished values such that the blackened concentration at a light exposed section is low while the concentration at an unexposed portion is high.

Therefore, a technology is desired providing a heat developable photosensitive material capable of obtaining images with low fog, high Dmax (maximum density), and less fog increase and less sensitivity deviations during preservation, as well as having advantages in terms of environments and costs.

Accordingly, the first object to be accomplished by the invention is to provide a heat developable photosensitive material capable of obtaining images with low fog and high Dmax (maximum density), particularly suitable for photomechanical processes as well as for scanners or image setters, with a good coating surface shape.

The second object of the invention is to be solved is to provide a heat developable photosensitive material capable of coating with water with advantages in terms of environments and costs.

SUMMARY OF THE INVENTION

The objects are accomplished by the means below. That is, this invention is as follows:

[1 ] A heat developable photosensitive material having on a support a non-photosensitive sliver salt, a photosensitive sliver halide emulsion, and a binder, wherein the photosensitive sliver halide emulsion comprises a photosensitive sliver halide and a low molecular weight gelatin having a molecular weight of 500 to 60,000.

[2] The heat developable photosensitive material according to [1], wherein the low molecular weight gelatin has a molecular weight of 1,000 to 40,000.

[3] The heat developable photosensitive material according to [1] or [2], wherein the photosensitive sliver halide emulsion comprises a photosensitive sliver halide which is formed independently of the non-photosensitive sliver salt.

[4] The heat developable photosensitive material according to any one of [1]–[3], wherein the emulsion is prepared by the method comprising the step of adding the low molecular weight gelatin to a desalted composition containing photosensitive sliver halide particles.

[5] The heat developable photosensitive material according to [4], wherein the emulsion is prepared by the method comprising the steps of preparing sliver halide particles in the presence of a gelatin having a molecular weight of more than 60,000, and desalting the resulting composition, and then adding the low molecular weight gelatin to a desalted composition.

[6] The heat developable photosensitive material according to any one of [1]–[5], wherein the emulsion is prepared by the method comprising the step of preparing sliver halide particles in the presence of the low molecular weight gelatin.

[7] The heat developable photosensitive material according to any one of [1]–[6], wherein the low molecular weight gelatin is an alkali-processed gelatin, an acid-processed gelatin or a phthalic gelatin.

[8] The heat developable photosensitive material according to [7], wherein the low molecular weight gelatin is an alkali-processed gelatin.

[9] The heat developable photosensitive material according to any one of [1]–[8], wherein at least 50% by weight of the binder of an image forming layer containing the photosensitive sliver halide is a polymer latex having a glass transition temperature of −30° C. to 40° C.

[10] The heat developable photosensitive material according to [9], wherein at least 70% by weight of the binder of an image forming layer containing the photosensitive sliver halide is a polymer latex having a glass transition temperature of −30° C. to 40° C.

[11] The heat developable photosensitive material according to any one of [1]–[10], which further comprises a nucleation agent.

DETAILED DESCRIPTION OF THE INVENTION

Figure 1:
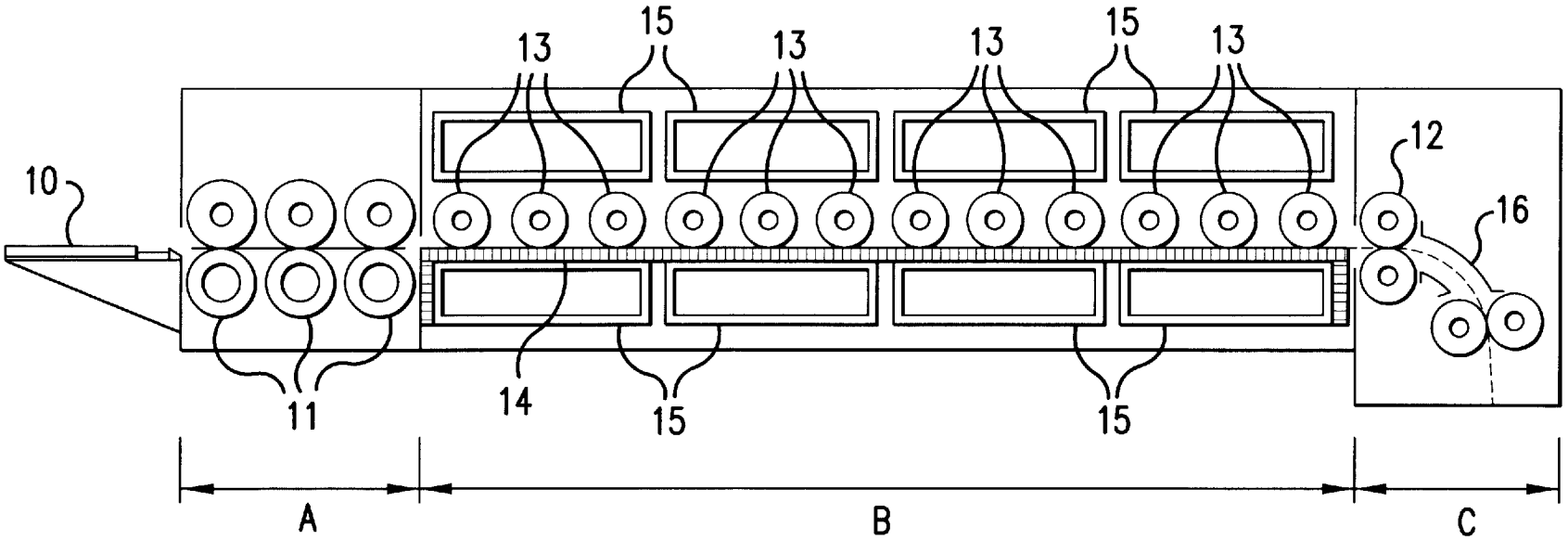
FIG. 1 is a side view showing a structural example of a heat developing machine.

Hereinafter, this invention is described in detail.

The heat developable photosensitive material of the invention has a photosensitive layer (emulsion layer) containing a silver halide emulsion which comprises a photosensitive silver halide. This photosensitive layer is preferably an image forming layer containing an organic silver salt serving as a non-photosensitive sliver salt and, more preferably, a high contrast sensitive material containing a nucleation agent. In such a heat developable photosensitive material, good photographic property such as excellent coating surface shape, low fog, high Dmax, high sensitivity, and the like can be obtained by using a low molecular weight gelatin in the silver halide emulsion. As for the high contrast sensitive material, high contract property becomes adequate. To the contrary, if a gelatin having a molecular weight exceeding 60,000 is used solely, the Dmax and sensitivity are lowered, and for the high contrast sensitive material, softening tendency becomes remarkable. The coating surface shape also becomes worse.

For the purpose of obtaining good photographic property, the photsensitive sliver halide is preferably not prepared by a method for converting a part of the organic silver salt to a photosensitive silver salt but formed beforehand as described below. Accordingly, in am image forming layer of a preferred embodiment of the invention, it is preferably to form the image forming layer in mixing the photosensitive sliver halide formed beforehand with the organic silver salt as described below. The image forming layer containing the photosensitive silver halide preferably employs a polymer latex having a glass transition temperature of −30° C. or higher and 40° C. or lower as a main binder to obtain good photographic property and allow a water based coating.

The low molecular weight gelatin contained in the silver halide emulsion containing the photosensitive silver halide used in this invention has a molecular weight of 500 to 60,000, preferably, a molecular weight of 1,000 to 40,000. The low molecular weight gelatin may be used during particle formation or during dispersion after desalting processing, and it is preferably to use the low molecular weight gelatin during dispersion after desalting processing. Alternatively, an ordinary gelatin (having a molecular weight of approximately 100,000) can be used during particle formation, and a low molecular weight gelatin may be used dispersion after desalting processing.

The low molecular weight gelatin used in this invention can be generally made as follows. A gelatin having an average molecular weight of 100,000, generally used, is dissolved in water, and a gelatin decomposing enzyme is added to decompose the gelatin moleculars with the enzyme. This method can be referred in a description, R. J. Cox, Photographic Gelatin II, Academic Press London, 1976, p233 to p251, p335 to p346. In this case, since bonding positions decomposed by the enzyme have been predetermined, a low molecular weight gelatin having a relatively narrow molecular weight profile is obtained, and it is desirable. In this case, if the enzyme decomposing time is made longer, the gelatin has a lower molecular weight. Alternatively, there is a method in which the material is heated in an atmosphere at low pH (pH 1 to 3) or high pH (pH 10 to 12) and then subject to hydrolysis.

If the average molecular weight exceeds 60,000, the advantages of the invention may not be obtained. If the average molecular weight is less than 500, such a gelatin is manufactured with hardship.

The low molecular weight gelatin is of 50% by weight or higher of the dispersion medium, more preferably, 70% by weight or higher.

The concentration of the dispersion medium may be 0.05 to 20% by weight, more preferably 5 to 15% be weight in terms of handling easiness. As kinds of the gelatin, alkali-processed gelatin is generally used, but also modified gelatin such as acid-processed gelatin, and phthalic gelatin can be used.

The photosensitive silver halide is not limited as a halogen composition, and can be made of silver chloride, silver chlorobromide, silver bromide, silver iodobromide, and silver iodochlorobromide. The profile of the halogen composition in the particle can be uniform, changed stepwise in the halogen composition, or change continuously. Silver halide particles having a core or shell structure can be used preferably. As a structure, a structure of two to five layers is preferably used, and more preferably, core or shell particles of a structure of two to four layers is used. A technology in which silver bromide is located on surfaces of the particles of silver chloride or silver chlorobromide can be used preferably.

The method of forming photosensitive silver halide used for the present invention is well known tin the art and, for example, the methods described in Research Disclosure, No. 17029 (June, 1978) and U.S. Pat. No. 3,700,458 may be used. Specifically, a method comprising converting a part of silver in the produced organic silver salt to photosensitive silver halide by adding a halogen-containing compound to the organic silver salt, or a method comprising adding a silver-supplying compound and a halogen-supplying compound to gelatin or other polymer solution to thereby prepare photosensitive silver halide and mixing the silver halide with an organic silver salt may be used for the present invention. The photosensitive silver halide particle preferably has a small particle size so as to prevent high white turbidity after the formation of an image. Specifically, the particle size is preferably 0.20 $\mu$m or less, more preferably from 0.01 to 0.15 $\mu$m, still more preferably from 0.02 to 0.12 $\mu$m. The term "particle size" as used herein means the length of an ridge of the silver halide particle in the case where the silver halide particle is a regular crystal such as cubic or octahedral particle; the diameter of a circle image having the same area as the projected area of the main surface plane in the case where the silver halide particle is a tabular silver halide particle; or the diameter of a sphere having the same volume as the silver halide particle in the case of other irregular crystals such as spherical or bar particle.

Examples of the shape of the silver halide particle include cubic form, octahedral form, tabular form, spherical form, stick form and bebble form, and among these, cubic particle and tabular particle are preferred in the present invention. When a tabular silver halide particle is used, the average aspect ratio is preferably from 100:1 to 2:1, more preferably from 50:1 to 3:1. A silver halide particle having rounded corners is also preferably used. The face index (Miller indices) of the outer surface plane of a photosensitive silver halide particle is not particularly limited; however, it is preferred that [100] faces capable of giving a high spectural sensitization efficiency upon adsorption of the spectral sensitizing dye occupy a high ratio. The ratio is preferably 50% or more, more preferably 65% or more, still more preferably 80% or more. The ratio of [100] faces according to the Miller indices can be determined by the method described in T. Tani, J. Imaging Sci., __29, 165 (1985) using the adsorption dependency of [111] face and [100] face upon adsorption of the sensitizing dye.

The photosensitive silver halide particle for use in the present invention contains a metal or metal complex or Group VII or VIII (the $7^{th}$ to $10^{th}$ groups) in the Periodic Table. The center metal of the metal or metal complex of Group VII or VIII of the Periodic Table is preferably rhodium, rhenium, ruthenium, osnium or iridium. One kind of metal complex may be used or two or more kinds of complexes of the same metal or different metals may also be used in combination. The metal complex content is preferably from $1\times10^{-9}$ to $1\times10^{-2}$ mol, more preferably from $1\times10^{-8}$ to $1\times10^{-4}$ mol, per mol of silver. With respect to the specific structure of the metal complex, the metal complexes having the structures described in JP-A-7-225,449 may be used.

As the rhodium compound for use in the present invention, a water-soluble rhodium compound may be used. Examples thereof include a rhodium(III) halaogenide compounds and rhodium complex salts having a halogen, an amine or an oxalate as a ligand, such as hexachlororhodium (III) complex salt, pentachloroaquorhodium(III) complex salt, tetrachlorodiaquorhodium(III) complex salt, hexabromorhodium (III) complex salt, hexaamminerhodium (III) complex salt and trioxalatorhodium(III) complex salt. The rhodium compound is used after dissolving it in water or an appropriate solvent and a method commonly used for stabilizing the rhodium compound solution, that is, a method comprising adding an aqueous solution of hydrogen halogenide (e.g., hydrochloric acid, bromic acid, fluoric acid) or halogenated alkali (e.g., KCl, NaCl, KBr, NaBr) may be used. In place of using a water-soluble rhodium, separate silver halide particles previously doped with rhodium may be added and dissolved at the time of preparation of silver halide.

The around of the rhodium compound added is preferably from $1\times10^{-8}$ to $5\times10^{-6}$ mol, more preferably from $5\times10^{-8}$ to $1\times10^{-6}$ mol, per mol of silver halide.

The rhodium compound may be appropriately added at the time of production of silver halide emulsion particles or at respective stages before coating of the emulsion. However, the rhodium compound is preferably added at the time of formation of the emulsion and integrated into the silver halide particle.

The rhenium, ruthenium or osmium for use in the present invention is added in the form of a water-soluble complex salt described in JP-A-63-2042, JP-A-1-285941, JP-A-2-20852 and JP-A-2-20855. A preferred example thereof is a six-coordinate complex salt represented by the following formula:

$$[ML_6]^{n-}$$

wherein M represents Ru, Re or Os, L represents a ligand, and n represents 0, 1, 2, 3 or 4. In this case, the counter ion plays no important role and an ammonium or alkali metal ion is used.

Preferred examples of the ligand include a halide ligand, a cyanide ligand, a cyan oxide ligand, a nitrosyl ligand and a thionitrosyl ligand. Specific examples of the complex for use in the present invention are shown below, but the present invention is by no means limited thereto.

| | | |
|---|---|---|
| $[ReCl_6]^{3-}$ | $[ReBr_6]^{3-}$ | $[ReCl_5(NO)]^{2-}$ |
| $[Re(NS)Br_5]^{2-}$ | $[Re(NO)(CN)_5]^{2-}$ | $[Re(O)_2(CN)_4]^{3-}$ |
| $[RuCl_6]^{3-}$ | $[RuCl_4(H_2O)_2]^{-}$ | $[RuCl_5(H_2O)]^{2-}$ |
| $[RuCl_5(NO)]^{2-}$ | $[RuBr_5(NS)]^{2-}$ | |
| $[Ru(CO)_3Cl_3]^{2-}$ | $[Ru(CO)Cl_5]^{2-}$ | $[Ru(CO)Br_5]^{2-}$ |
| $[OsCl_6]^{3-}$ | $[OsCl_5(NO)]^{2-}$ | $[Os(NO)(CN)_5]^{2-}$ |
| $[Os(NS)Br_5]^{-2-}$ | $[Os(O)_2(CN)_4]4-$ | |

The addition amount of these compound is preferably from $1\times10^{-9}$ to $1\times10^{-5}$ mol, more preferably from $1\times10^{-8}$ to $1\times10^{-6}$ mol, per mol of silver halide.

These compounds may be added appropriately at the time of preparation of silver halide emulsion particles or at respective stages before coating of the emulsion, but the compounds are preferably added at the time of formation of the emulsion and integrated into a silver halide particle.

For adding the compound during the particle formation of silver halide and integrating it into a silver halide particle, a method where a metal complex powder or an aqueous solution having dissolved therein the metal complex together with NaCl or KCl is added to a water-soluble salt or water-soluble halide solution during the particle formation, a method where the compound is added as the third solution at the time of simultaneously mixing a silver salt and a halide solution to prepare silver halide particles by the triple jet method, or a method where a necessary amount of an aqueous metal complex solution is pouted into a reaction vessel during the particle formation, may be used. Among these, preferred is a method comprising adding a metal complex powder or an aqueous solution having dissolved therein the metal complex together with NaCl or KCl to a water-soluble halide solution.

In order to add the compound to the particle surface, a necessary amount of an aqueous metal complex solution may be charged into a reaction vessel immediately after the particle formation, during or after completion of the physical ripening, or at the time of chemical ripening.

As the iridium compound for use in the present invention, various compounds may be used, and examples thereof include hexachloroiridium, hexammineiridium, trioxalatoiridium, hexacyanoiridium and pentachloronitrosyliridium. The iridium compound is used after dissolving it in water or an appropriate solvent, and a method commonly used for stabilizing the iridium compound solution, more specifically, a method comprising adding an aqueous solution of hydrogen halogenide (e.g., hydrochloric acid, bromic acid, fluoric acid) or halogenated alkali (e.g., KCl, NaCl, KBr, NaBr) may be used. In place of using a water-soluble iridium, separate silver halide particles previously doped with iridium may be added and dissolved at the time of preparation of silver halide.

The silver halide particle for use in the present invention may further contain a metal atom such as cobalt, iron, nickel, chromium, palladium, platinum, gold, thallium, copper and lead. In the case of cobalt, iron, chromium or ruthenium compound, a hexacyano metal complex is preferably used. Specific examples thereof include ferricyanate ion, ferrocyanate ion, hexacyanocobaltate ion, hexacyanochromate ion and hexacyanoruthenate ion. However, the present invention is by no means limited thereto. The phase of the silver halide, in which the metal complex is contained, is not particularly limited, and the phase may be uniform or the metal complex may be contained in a higher concentration in the core part or in the shell part.

The above-described metal is used preferably in an amount of from $1\times10^{-9}$ to $1\times10^{-4}$ mol per mol of silver halide. The metal may be converted into a metal salt in the form of a simple salt, a composite salt or a complex salt and added at the time of preparation of particles.

The photosensitive silver halide particle may be desalted by water washing according to a method known in the art, such as noodle washing and flocculation, but the particle may not be desalted in the present invention.

As a gold sensitizer used when the silver halide emulsion of the invention is subject to gold sensitization, gold compound used ordinarily as a gold sensitizer having an oxidation number of monovalent or trivalent can be used. As representative examples, chroloaurate, potassium chroloaurate, auricrichloride, potassium auricriocyanate, postassium iodaurate, tetracyanoauric acid, ammonium aurotiocyanate, pyrdyltrichlorogold, and the like are exemplified.

The addition amount of the gold sensitizer may vary depending on each condition, and as a standard, it is $10^{-7}$ mol or higher and $10^{-3}$ mol or lower per one mol of the silver halide, and more preferably, it is $10^{-6}$ mold or higher and $5\times10^{-4}$ mol or lower.

It is preferably to use together the gold sensitization and other chemical sensitizations for the silver halide emulsion of the invention. As other chemical sensitizations, the chemical sensitization may be performed using a known method such as sulfur sensitization, selenium sensitization, tellurium sensitization or noble metal sensitization. These sensitization method may be used alone of in any combination. When these sensitization methods are used as a combination, a combination of sulfur sensitization and gold sensitization, a combination of sulfur sensitization, selenium sensitization and gold sensitization, a combination of sulfur sensitization, tellurium sensitization and gold sensitization, and a combination of sulfur sensitization, selenium sensitization, tellurium sensitization and gold sensitization, for example, are preferred.

The sulfur sensitization preferably used in the present invention is usually performed by adding a sulfur sensitizer and stirring the emulsion at a high temperature of 40° C. or higher for a predetermined time. The sulfur sensitizer may be a known compound and examples thereof include, in addition to the sulfur compound contained in gelatin, various sulfur compounds such as thiosulfates, thioureas, thiazoles and rhodanines. Preferred sulfur compounds are a thiosulfate and a thiourea compound. The amount of the sulfur sensitizer added varies depending upon various conditions such as the pH and the temperature at the chemical ripening and the size of silver halide grain. However, it is preferably from $10^{-7}$ to $10^{-2}$ mol, more preferably from $10^{-5}$ to $10^{-3}$ mol, per mol of silver halide.

The selenium sensitizer for use in the present invention may be a known selenium compound. The selenium sensitization is usually performed by adding a labile and/or non-labile selenium compound and stirring the emulsion at a high temperature of 40° C. or higher for a predetermined time. Examples of the labile selenium compound include the compounds described in JP-B-44-15748, JP-B-43-13489, JP-A-4-25832, JP-A-4-109240 and JP-A-4-324855. Among these, particularly preferred are the compounds represented by formulae (VIII) and (IX) of JP-A-4-324855.

The tellurium sensitizer for use in the present invention is a compound of forming silver telluride presumed to work out to a sensitization nucleus, on the surface or in the inside of a silver halide grain. The rate of the formation of silver telluride in a silver halide emulsion can be examined according to a method described in JP-A-5-313284. Examples of the tellurium sensitizer include diacyl tellurides, bis(oxycarbonyl) tellurides, bis(carbamoyl) tellurides, diacyl tellurides, bis(oxycarbonyl) ditellurides, bis(carbamoyl) ditellurides, compounds having a P═Te bond, tellurocarboxylates, Te-organyltellurocarboxylic acid esters, di(poly)tellurides, tellurides, tellurols, telluroacetals, tellurosulfonates, compounds having a P—Te bond, Te-containing hetarocyclic rings, tellurcarbonyl compounds, inorganic tellurium compounds and colloidal tellurium. Specific examples thereof include the compounds described in U.S. Pat. Nos. 1,623,499, 3,320,069 and 3,772,031, British Patent Nos. 23,211, 1,121,496, 1,295,462 and 1,396,696, Canadian Patent No. 800,858, JP-A-4-204640, JP-A-3-53693, JP-A-4-271341, JP-A-4-333043, JP-A-5-303157, J. Chem. Soc. Chem. Commun., 635 (1980), ibid., 1102 (1979), ibid., 645 (1979), J. Chem. Soc. Perkin. Trans., 1, 2191 (1980), S. Patai (compiler), The Chemistry of Organic Selenium and Tellurium Compounds, Vol. 1 (1986), and ibid., Vol. 2 (1987). The compounds represented by formulae (II), (III) and (IV) of JP-A-5-313284 are particularly preferred.

The amount of the selenium or tellurium sensitizer used in the present invention varies depending on silver halide grains used or chemical ripening conditions. However, it is usually from $10^{-8}$ to $10^{-2}$ mol, preferably on the order of from $10^{-7}$ to $10^{-3}$ mol, per mol of silver halide. The conditions for chemical sensitization in the present invention are not particularly restricted. However, in general, the pH is from 5 to 8, the pAg is from 6 to 11, preferably from 7 to 10, and the temperature is from 40 to 95° C., preferably from 45 to 85° C.

In the silver halide emulsion for use in the present invention, a cadmium salt, sulfite, lead salt or thallium salt may be allowed to be present together during formation or physical ripening of silver halide grains.

In the present invention, reduction sensitization may be used. Specific examples of the compound used in the reduction sensitization include an ascorbic acid, thiourea dioxide, stannous chlordie, aminoiminomethanesulfinic acid, a hydrazine derivative, a borane compound, a silane compound and a polyamine compound. The reduction sensitization may be performed by ripening the grain while keeping the emulsion at pH of 7 or more or at a pAg of 8.3 or less. Also, the reduction sensitization may be performed by introducing a single addition part of silver ion during the formation of grains.

To the silver halide emulsion of the present invention, a thiosulfonic acid compound may be added by the method described in European Paten 293917A.

In the heat-developable image-forming material of the present invention, one kind of silver halide emulsion may be used or two or more kinds of silver halide emulsions (for example, those different in the average grain size, different in the halogen composition, different in the crystal habit or different in the chemical sensitization conditionals) may be used in combination.

The amount of the photosensitive silver halide used in the present invention is preferably from 0.01 to 0.5 mol, more preferably from 0.02 to 0.3 mol, still more preferably from 0.03 to 0.25 mol, per mol of the organic silver salt. The method and conditions for mixing photosensitive silver halide and organic silver salt which are prepared separately are not particularly limited as far as the effect of the present invention can be brought out satisfactorily. However, a method of mixing the silver halide grains and the organic silver salt after completion of respective preparations in high-speed stirring machine, a ball mill, a sand mill, a colloid mill, a vibrating mill or a homogenizer or the like, or a method involving preparing organic silver salt while mixing therewith photosensitive silver halide after completion of the preparation in any timing during preparation of the organic silver salt, or the like may be used.

The organic silver salt unable in the present invention is a silver salt which is relatively stable against light but forms a silver image when it is heated at 80° C. or higher in the presence of an exposed photocatalyst (e.g., a latent image of photosensitive silver halide) and a reducing agent. The organic silver salt may be any organic substance containing a source capable of reducing the silver ion. A silver salt of an organic acid, particularly a silver salt of a long chained aliphatic carboxylic acid (having from 10 to 30, preferably from 15 to 28 carbon atoms) is preferred. A complex of an organic or inorganic silver salt, of which ligand has a complex stability constant of from 4.0 to 10.0, is also prefereed. The silver-supplying substance may constitute preferable from about 5 to 70% by weigh of the image-forming layer. The preferred organic silver salt includes a silver salt of an organic compound having a carboxyl group. Examples thereof include an aliphatic carboxylic acid silver salt and an aromatic carboxylic acid silver salt. However, the present invention is by no means limited thereto. Preferred examples of the aliphatic carboxylic acid silver salt include silver behenate, silver arachidinate, silver stearate, silver oleate, silver laurate, silver caproate, silver myristate, silver palmitate, silver maleate, silver fumarate, silver tartrate, silver linoleate, silver butyrate, silver camphoraote and a mixture thereof.

In this invention, it is preferable to use, among the organic acid silvers or mixtures of the organic acid silvers exemplified above, the organic acid silver having a silver behenate containing rate of 85 mol % or higher, more preferably 95 mol % or higher. The silver behenate containing rate indicates a mole percentage of the silver behenate to the organic acid silver to be used. As organic acid silver other than the silver behenate contained in the organic acid silver used in the invention, the above exemplified materials can be used preferably.

The organic acid silvers preferably used in this invention are prepared by reaction of an alkali metal salt (sodium salt, potassium salt, lithium salt, and the like can exemplified) solution or suspension of the organic acid silver as described above with silver nitrate. The organic acid alkali metal salt of the present invention can be obtained from alkali treatments of the organic acid. The organic acid silver of the invention can be done in either a rotary or continuous manner in an arbitrary suitable container. Stirring in the reaction container can be done by any stirring method depending on the characteristics demanded from the particles. As a preparing method for organic acid silver, any of methods can be preferably used in which a silver nitrate solution is slowly or rapidly added in a reaction container an organic acid alkali metal salt solution or suspension, in which a previously prepared organic acid alkali metal salt solution or suspension is slowly or rapidly added in a reaction container containing a silver nitrate solution, and in which a previously prepared silver nitrate solution and an organic acid alkali metal salt solution or suspension are added at the same time in a reaction container.

The silver nitrate solution and the organic acid alkali metal salt solution or suspension can be used with any concentration to control the particle size of the prepared organic acid silver, and can be added with any addition rate. As a method for adding the silver nitrate solution and the organic acid alkali metal salt solution or suspension, a method for adding at a constant addition rate, a method for acceleratingly or deceleratingly adding according to an arbitrary time function can be used. The solution and the like can be added to the reaction composition at the composition surface or in the composition. In the case of the method in which the previously prepared silver nitrate solution and the organic acid alkali metal salt solution or suspension are added at the same time in a reaction container, though any of the silver nitrate solution and the organic acid alkali metal salt solution or suspension can be added first, it is preferable to add the silver nitrate solution first. As a preceding degree, an amount of 0 to 50% of the total amount is used preferably, and more preferably, it is 0 to 25%. A method in which addition is made while the pH and the silver potential of a reaction composition is controlled during reaction as described in JP-A-9-127,643.

The silver nitrate solution and the organic acid alkali metal salt solution or suspension to be added can control the pH according to the characteristics demanded from the particles. To adjust the pH, an arbitrary acid or alkali can be added. According to the characteristics demanded from the particles, for example, for controlling the particle size of the prepared organic acid silver, the temperature in the reaction container can be set arbitrarily, but also the silver nitrate solution and the organic acid alkali metal salt solution or suspension can be adjusted at an arbitrary temperature. To make sure the fluidity of the organic acid alkali metal salt solution or suspension, it is preferable to keep at 50° C. or higher with heating.

The organic acid silver used in this invention is preferably prepared in the presence of a tertiary alcohol. As a tertiary alcohol, it is preferable to use an alcohol having a total carbon number of 15 or less, more preferably 10 or less. As an example of a preferable tertiary alcohol, tert-butanol and the like are exemplified, but this invention is not limited to those.

Although the timing of addition of the tertiary alcohol used in this invention can be any timing during the preparation of the organic acid silver, it is preferable to solve and use the organic acid alkali metal salt upon addition of the alcohol during the preparation of the organic acid alkali metal salt. The use amount of the tertiary alcohol of the invention can be any amount in range of 0.01 to 10 by weight ratio to $H_2O$ as a solvent during the preparation of the organic acid silver, but the range of 0.03 to 1 is preferable.

As a shape of the organic silver salt usable in this invention, there is no special limited to it, but a needle crystal having the minor axis and the major axis. In this invention, it is preferable that the minor axis if of 0.01 micron or more and 0.20 micron or less while the major axis is of 0.10 micron or more and 5.0 microns or less, and more preferably, it is that the minor axis of of 0.01 micron or more and 0.15 micron or less while the major axis is of 0.10 micron or more and 4.0 microns or less. The size profile of the particles of the organic silver salt is preferably a single dispersion. The single dispersion is defined that the percentage of the standard deviation of the lengths of the minor and major axes divided by the minor and major axes, respectively, is preferably, 100% or less, more preferably, 80% or less, and further preferably, 50% or less. As a measuring method of shapes of the organic silver salt, it can be sought by an image made with a transmission type electron microscope of an organic silver salt dispersion. As another method for measuring the single dispersion, there is a method for seeking the standard deviation of the volume weighted mean diameter of the organic silver salt, and the percentage (deviation coefficient) of a value divided by the volume weighted mean diameter is preferably, 100% or less, more preferably, 80% or less, and further preferably, 50% or less. As a measuring method, a laser beam is radiated to the organic silver salt dispersed in the composition, and it can be sought from obtained particle sizes (volume weighted mean diameter) through a self-correlation function with respect to time change of fluctuation of the scattered light of the laser beam.

The organic silver salt usable in this invention is preferably subject to desalting. There is no special limitation to methods for desalting, and known methods can be used. It is preferable to use known filtering methods such as centrifugal filtering, absorbing filtering, ultrafiltration, frock forming washing by cohesion method, and so on.

In this invention, for obtaining a solid dispersed material of organic silver salt having a smaller particle size with high S/N ratio and without cohesion, a dispersion method is preferably used in which a pressure is decreased after a water dispersion including an organic silver salt serving as image forming media and substantially excluding photosensitive silver salt is converted into a high speed flow.

A photosensitive image forming medium coating composition is manufactured in mixing the photosensitive silver salt solution after such a process. If a heat developable photosensitive material is produced using such a coating composition, a heat developable photosensitive material can be obtained with low haze, low fog and high sensitivity. To the contrary, if the flow is converted to high pressure, high speed flow, and if the photosensitive silver coexists during the dispersion, the fog increases and the sensitivity is lowered so much. If an organic solvent, instead of water, is used for a dispersing medium, the haze becomes so high, and the fog increases, while the sensitivity is likely lowered. On the other hand, if a conversion method in which a part of the organic silver salt in the dispersion is converted into a photosensitive silver salt is used, the sensitivity is reduced.

The water dispersion dispersed upon conversion to high pressure and high speed flow substantially excludes a photosensitive silver salt, and the moisture amount is 0.1 mol % or less with respect to the non-photosensitive type organic silver salt, and the photosensitive silver salt is not positively added.

In this invention, a solid dispersion apparatus and its technology used for implementing the above dispersing methods are described in detail in, e.g., "Bunsankei Rheology to Bunsankagijyutu (Disperse System Rheology and Dispersing Technology)", Toshio Kajiuchi, Hiroki Usui, 1991 Shinzannsya Shuppan (K. K.) p357 to p403, and "Kagaku Kogyou no Sinpo, Dai 24 shyu (Progress of Chemical Engineering, Vol. 24), Shyadan Houjinn, Kagakukougyou-kai Tokai shibu, 1990, Maki Shoten, p184 to p185. The dispersing method in this invention is a method in which, after a water dispersion material at least including an organic silver salt is sent in a pipe upon pressurized by means of, e.g., a high pressure pump, the material is made to pass through fine slits formed in the pipe, and subsequently the dispersion is rapidly subject to a reduced pressure thereby forming fine dispersions.

With respect to a high pressure homogenizer relating to this invention, it is generally thought that dispersion to fine particles occurs by, e.g., "shearing force" occurring at a time when the dispersoid passes through narrow intervals with high pressure and high speed, and "cavitation force" occurring when the dispersoid is released from the high pressure to the normal pressure. A Gorlin homogenizer can be exemplified as a dispersing apparatus of this type, and in this apparatus, a liquid to be dispersed under a high pressure is converted at narrow channels on a cylindrical surface to a high speed fluid, and collides to surrounding walls with that acceleration, thereby forming emulsion and dispersion by the impacting force. The pressure used is generally in a range of 100 to 600 kg/cm$^2$, and the fluid rate is in a range of several meters to 30 meters per second. To increase the dispersing effect, some are devised to have the high speed portion in a serriform to increase the number of collisions. Meanwhile, recently developed apparatuses are capable of dispersing with further higher pressure and higher flow velocity, and as a representative example, such as Microfluidizer (Microfluidics International Corporation), Nanomizer (Tokusyu Kika Kougyou (K. K.) can be exemplified.

As a dispersing apparatus suitable for this invention, Microfluidizer (Microfluidics International Corporation made), M-110S-EH [G10Z with interaction chamber], M-110Y [H10Z with interaction chamber], M-140K [G10Z with interaction chamber], HC-5000 [L30Z or H230Z with interaction chamber], HC-8000 [E230Z or L30Z with interaction chamber], and the like are exemplified.

A most suitable organic silver salt dispersed material for this invention can be obtained, using those apparatuses, by creating rapid reduction of pressure in the dispersion by a method such that the pressure in the pipe is rapidly backed to the atmospheric pressure after applying a desired pressure to a water dispersion including at least an organic silver salt by passing the composition through fine slits formed in the pipe after the composition is sent to the pipe with pressure from a high pressure pump or the like.

Before the dispersion manipulation, it is preferable to disperse the raw material previously. As a means for pre-dispersion, known dispersing means (such as a high speed mixer, homogenizer, high impact mill, banbury mixer, homo mixer, kneader, bowl mill, vibration bowl mill, planet bowl mill, attriter, sand mill, beads mill, colloid mill, jet mill, roller mill, tron mill, high speed stone mill) can be used. The composition can be made with fine particles, in a way other than subjecting to the mechanical dispersion, by changing the pH in the presence of dispersion promoters after rough dispersion is made in the solvent by a pH control. As a solvent for the rough dispersion, an organic solvent can be used, and normally, the organic solvent is removed making the fluid with fine particles.

In the dispersion of the organic silver salt in the invention, the dispersion can be made with desired particle sizes by adjustments of the fluid speed, the differential pressures during pressure reduction, and the number of processings. From a standpoint to the photographic characteristics and the particle sizes, a preferable fluid speed is of 200 m/sec to 600 m/sec, and the differential pressure during the reduction of the pressure is preferably in range of 900 to 3,000 kg/cm$^2$. More preferably, the fluid speed is of 300 m/sec to 600 m/sec, and the differential pressure during the reduction of the pressure is preferably in range of 1,500 to 3,000 kg/cm$^2$. The processing number of dispersions can be selected according the necessity, and in a normal case, the processing number of one to ten times is selected, and from a standpoint of productivity, the processing number of one to three times is selected. Making the water dispersion at a high temperature under a high pressure is not favorable in terms of dispersion property and photographic characteristics, and if the temperature is high as to exceed 90° C., the particle size may be larger, and fog may increase. Accordingly, in this invention, a cooling process may be contained in either or both of a process before conversion to the high speed flow and a process after the pressure is reduce, and it is preferable to keep the temperature of such a water dispersion in a range of 5 to 90° C. by such a cooling process, more preferably, in range of 5 to 80° C., and further 5 to 60° C. Furthermore, it is effective to set the cooling process as described above for high pressure dispersion in a range of 1500 to 3000 kg/cm$^2$. The cooling apparatus can be selected from a double pipe, one using a static mixer for a double pipe, a multiple pipe type heat converter, a jig-sag pipe type heat converter, and the like. To increase the efficiency of the heat conversion, diameter, thickness, and material of the pipe are selected to be suitable in consideration of the used pressure. The coolant used in the cooling apparatus can be, in consideration of the heat conversion amount, a well water of 20° C. or a cool water of 5 to 10° C. processed in a refrigerator, or a coolant of ethylene glycol and water of −30° C. when necessary.

In a dispersion manipulation of the invention, it is preferable to disperse the organic silver salt in the presence of a dispersant (dispersion promoter) soluble in an aqueous solvent. As a dispersion promoter, for example, synthetic anion polymers such as polyacrylic acid, acrylic acid copolymer, maleic acid monoester copolymer, and acryromethyl propanesulfonic acid copolymer, semi-synthetic anion polymers such as carboxylmethyl starch, and carboxylmethyl cellulose, anionic polymers such as alginic acid, and pectic acid, a compound as set forth in JP-A-7-350, 753, known polymers such as anionic, nonionic, or cationic surfactants, and polyvinylalcohol, polyvinylpyrrolidone, carboxymethylcellulose, hydroxymethylcellulose, and hydroxypropylmethylcellulose, and a polymer compound existing naturally such as gelatin or the like can be used, and furthermore, polyvinylalcohol groups, and water-soluble cellulose derivatives can be used more preferably.

The dispersion promoter is made ordinarily by being mixed with powders of the organic silver salt or a wet cake state organic silver salt to be sent to a dispersing machine as a slurry, but can be mixed with the powers of the organic silver salt or a wet cake state organic silver salt upon processing of a thermal treatment or solvent treatment where mixed with the organic silver salt in advance. It can be subject to a pH control with a proper pH adjusting agent before or after or during dispersion.

In addition to the mechanical dispersion, the dispersion promoter can be dispersed roughly upon the pH control, and then, fine particles can be formed upon changing the pH in the presence of the dispersion promoter, At that time, as a solvent used for the rough dispersion, an organic solvent can be used, and ordinarily, such an organic solvent is removed after making fine particles.

The prepared dispersed materials may be preserved while being stirred to suppress precipitation of fine particles during preservation or preserved at a high viscosity state (for example, gelatin is used in a jelly state) by means of hydrophilic colloids. An antiseptics may be added to prevent bacteria or the like from prospering.

The particle size (volume weighted mean diameter) of the solid fine particle dispersing material of the organic silver salt of the invention can be sought from, e.g., obtained particle sizes (volume weighted mean diameter) through a self-correlation function with respect to time change of fluctuation of a scattered light where a laser beam is radiated to the solid fine particle dispersing material dispersed in the composition. The solid fine particle dispersing material desirably has a mean particle size of 0.05 micron or higher and 10.0 microns or lower, more preferably, a mean particle size of 0.1 micron or higher and 5.0 microns or lower, and further preferably, a mean particle size of 0.1 micron or higher and 2.0 microns or lower.

The particle size profile of the organic silver salt is preferable in a single dispersion. More specifically, the percentage (deviation coefficient) of a value that the standard deviation of the volume weighted mean diameter is divided by the volume weighted mean diameter is preferably, 80% or less, more preferably, 50% or less, and further preferably, 30% or less. As a measuring method of shapes of the organic silver salt, it can be sought by an image made with a transmission type electron microscope of an organic silver salt dispersion.

The solid fine particle dispersing material of the organic silver salt used in the invention includes at least the organic silver salt and water. There is no special limitation to the rate of the organic silver salt and the water, but the rate of the organic silver salt to the entirety is preferably 5 to 50% by weight, and more preferably, 10 to 30% by weight. It is preferable to use the dispersion promoter as described above. It is preferable to use it in a minimum amount in a range suitable for minimizing the particle size, and it is preferable to set it 0.5 to 30% by weight and particularly, in a range of 1 to 15% by weight.

With this invention, the photosensitive material can be manufactured by mixing the organic silver salt water dispersion and the photosensitive sliver salt water dispersion with each other. The mixing race of the organic silver salt and the photosensitive silver can be selected depending on the purpose, and the rate of the organic silver salt to the photosensitive silver salt is preferably in a range of 1 to 30 mol %, more preferably, 3 to 20 mol %, and further preferably, 5 to 15 mol %. To mix two or more types of the organic silver salt water dispersions and two or more types of the photosensitive used salt water dispersions with each other is a suitable method was for adjusting the photographic property.

The organic silver salt of the invention can be used in a desired amount, and if indicated with a coating amount of sensitive material per square meter, the suitable silver amount is 0.1 to 5 g/m$^2$, more preferably, 1 to 3 g/m$^2$.

In this invention, a metal ion or ions selected from Ca, Mg, Zn, and Ag can be preferably added to the non-photosensitive organic silver salt. The addition of the metal ion or ions selected from Ca, Mg, Zn, and Ag to the non-photosensitive organic silver salt is preferably made in a form of not a halide, but a water-soluble metal salt, more specifically, in a form of a nitrate, a sulfite, or the like. Addition of halide is not preferable because image preservation property, in other words, printout property of the photosensitive material is made inferior due to light (e.g., room light or sun light) after the processing. Therefore, in this invention, not the above halide but the addition in the form of the water-soluble metal salt is preferably used.

As an addition timing of the metal ion or ions selected from Ca, Mg, Zn, and Ag preferably used in this invention, any timing can be used such as after particle forming of a non-photosensitive organic silver salt, right after particle forming, before dispersion, after dispersion, and before or after preparation of the coating composition, as far as it is right before the coating or earlier, and more preferably, it is after dispersion, or before or after preparation of the coating composition.

As an addition amount of the metal ion or ions selected from Ca, Mg, Zn, and Ag in this invention, it is of $10^{-3}$ to $10^{-1}$ mol per one mol of the non-photosensitive organic silver, and more preferably, $5\times10^{-3}$ to $5\times10^{-2}$ mol.

As a nucleation agent used for this invention, preferably used are substituted alkene derivatives, substituted isooxazole derivatives, and specific acetal compounds.

The substituted alkene derivatives represented by Formula (1), substituted isooxazole derivatives representative by Formula (2), specific acetal compounds represented by Formula (3) for use in the present invention will be explained below.

(1)

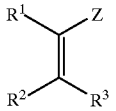

(2)

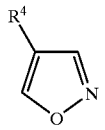

(3)

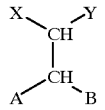

In Formula (1), $R^1$, $R^2$ and $R^3$ each independently represents a hydrogen atom or a substituent, z represents an electron withdrawing group or a silyl group, and $R^1$ and Z, $R^2$ and $R^3$, $R^1$ and $R^2$, or $R^3$ and Z may be combined with each other to form a ring structure; in Formula (2), $R^4$ represents a substituent; and in Formula (3), X and Y each independently represents a hydrogen atom or a substituent, A and B each independently represents an alkoxy group, an alkylthio group, a alkylamino group, an aryloxy group, an arylthio group, an anilino group, a heterocyclic oxy group, a heterocyclic thio group or a heterocyclic amino group, and X and Y, or A and B may be combined with each other to form a ring structure.

The compound represented by Formula (1) is described in detail below.

In Formula (1), $R^1$, $R^2$ and $R^3$ each independently represents a hydrogen atom or a substituent, and Z represents an electron withdrawing group or a silyl group. In Formula (1), $R^1$ and Z, $R^2$ and $R^3$, $R^1$ and $R^2$, or $R^3$ and Z may be combined with each other to form a ring structure.

When $R^1$, $R^2$ or $R^3$ represents a substituent, examples of the substituent include a halogen atom (e.g., fluorine, chlorine, bromide, iodine), an alkyl group (including an aralkyl group, a cycloalkyl group and active methine group), an alkenyl group, an alkynyl group, an aryl group, a heterocyclic group (including N-substituted nitrogen-containing heterocyclic group), a quaternized nitrogen-containing heterocyclic group (e.g., pyridinio group), an acyl group, an alkoxycarbonyl group, an aryloxycarbonyl group, a carbamoyl group, a carboxy group or a salt thereof, an imino group, an imino group substituted by N atom, a thiocarbonyl group, a sulfonylcarbamoyl group, an acylcarbamoyl group, a sulfamoylcarbamoyl group, a carbazoyl group, an oxalyl group, an oxamoyl group, a cyano group, a thiocarbamoyl group, a hydroxy group (or a salt thereof), an alkoxy group (including a group containing an ethyleneoxy group or propyleneoxy group repeating unit), an aryloxy group, a heterocyclic oxy group, an acyloxy group, an (alkoxy or aryloxy) carbonyloxy group, a carbamoyloxy group, a sulfonyloxy group, an amino group, an (alkyl, aryl or heterocyclic)amino group, an acylamino group, a sulfonamido group, a ureido group, a thioureido group, an imido group, an (alkoxy or aryloxy)carbonylamino group, a sulfamoylamino group, a semicarbazide group, a thiosemicarbazide group, a hydrazino group, a quaternary ammonio group, an oxamoylamino group, an (alkyl or aryl) sulfonylureido group, an acylureido group, an acylsulfamoylamino group, a nitro group, a mercapto group or a salt thereof, an (alkyl, aryl or heterocyclic)thio group, an acylthio group, an (alkyl or aryl)sulfonyl group, an (alkyl or aryl)sulfinyl group, a sulfo group or a salt thereof, a sulfamoyl group, an acylsulfamoyl group, a sulfonylsulfamoyl group or a salt thereof, a phosphoryl group, a group containing phosphoramide or phosphoric acid ester structure, a silyl group and a stannyl group.

These substituents each may further be substituted by any of the above-described substituents.

The electron withdrawing group represented by Z in Formula (1) is a substituent having a Hammett's substituent constant op of a positive value, and specific examples thereof include a cyano group, an alkoxycarbonyl group, an aryloxycarbonyl group, a carbamoyl group, an imino group, an imino group substituted by N atom, a thiocarbonyl group, a sulfamoyl group, an alkylsulfonyl group, an arylsulfonyl group, a nitro group, a halogen atom, a perfluoroalkyl group, a perfluoroalkanamido group, a sulfonamido group, an acyl group, a formyl group, a phosphoryl group, a carboxy group (or a salt thereof), a sulfo group (or a salt thereof), a heterocyclic group, an alkenyl group, an alkynyl group, an acyloxy group, an acylthio group, a sulfonyloxy group and an aryl group substituted by the above-described electron withdrawing group. The heterocyclic group is a saturated or unsaturated heterocyclic group and examples thereof include a pyridyl group, a quinolyl group, a pyrazinyl group, a quinoxalinyl group, a benzotriazolyl group, an imidazolyl group, a benzimidazolyl group, a hydantoin-1-yl group, a succinimido group and a phthalimido group.

The electron withdrawing group represented by Z in Formula (1) may further have a substituent and examples of the substituent include those described for the substituent which the substituent represented by $R^1$, $R^2$ or $R^3$ in Formula (1) may have.

In Formula (1), $R^1$ and Z, $R^2$ and $R^3$, $R^1$ and $R^2$, or $R^3$ and Z may be combined with each other to form a ring structure. The ring structure formed is a non-aromatic carbocyclic ring or a non-aromatic heterocyclic ring.

The preferred range of the compound represented by Formula (1) is described below.

The silyl group represented by Z in Formula (1) is preferably a trimethylsilyl group, a t-butyldimethylsilyl group, a phenyldimethylsilyl group, a triethylsily group, a triisopropylsilyl group or a trimethylsilyldimethylsilyl group.

The electron withdrawing group represented by Z in Formula (1) is preferably a group having a total carbon atom number of from 0 to 30 such as a cyano group, an alkoxycarbonyl group, an aryloxycarbonyl group, a carbamoyl group, a thiocarbonyl group, an imino group, an imino group substituted by N atom, a sulfamoyl group, an alkylsulfonyl group, an arylsulfonyl group, a nitro group, a perfluoroalkyl group, an acyl group, a formyl group, a phosphoryl group, an acyloxy group, an acylthio group or a phenyl group substituted by any electron withdrawing group, more preferably a cyano group, an alkoxycarbonyl group, a carbamoyl group, an imino group, a sulfamoyl group, an alkylsulfonyl group, an arylsulfonyl group, an acyl group, a formyl group, a phosphoryl group, a trifluoromethyl group or a phenyl group substituted by an electron withdrawing group, still more preferably a cyano group, a formyl group, an acyl group, an alkoxycarbonyl group, an imino group or a carbamoyl group.

The group represented by Z in Formula (1) is preferably an electron withdrawing group.

The substituent represented by $R^1$, $R^2$ or $R^3$ in Formula (1) is preferably a group having a total carbon atom number of from 0 to 30 and specific examples of the group include a group having the same meaning as the electron withdrawing group represented by Z in Formula (1), an alkyl group, a hydroxy group (or a salt thereof), a mercapto group (or a salt thereof), an alkoxy group, an aryloxy group, a heterocyclic oxy group, an alkylthio group, an arylthio group, a heterocyclic thio group, an amino group, an alkylamino group, an arylamino group, a heterocyclic amino group, a ureido group, an acylamino group, a sulfonamido group and a substituted or unsubstituted aryl group.

In Formula (1), $R^1$ is preferably an electron withdrawing group, an aryl group, an alkylthio group, an alkoxy group, an acylamino group, a hydrogen atom or a silyl group.

When $R^1$ represents an electron withdrawing group, the electron withdrawing group is preferably a group having a total carbon atom number of from 0 to 30 such as a cyano group, a nitro group, an acyl group, a formyl group, an alkoxycarbonyl group, an aryloxycarbonyl group, a thiocarbonyl group, an imino group, an imino group substituted by N atom, an alkylsulfonyl group, an arylsulfonyl group, a carbamoyl group, a sulfamoyl group, a trifluoromethyl group, a phosphoryl group, a carboxy group (or a salt thereof), a saturated or unsaturated heterocyclic group, more preferably a cyano group, an acyl group, a formyl group, an alkoxycarbonyl group, a carbamoyl group, an imino group, an imino group substituted by N atom, a sulfamoyl group, a carboxy group (or a salt thereof) or a saturated or unsaturated heterocyclic group, still more preferably a cyano group, a formyl group, an acyl group, an alkoxycarbonyl group, a carbamoyl group or a saturated or unsaturated heterocylic group.

When $R^1$ represents an aryl group, the aryl group is preferably a substituted or unsubstituted phenyl group having a total carbon atom number of from 6 to 30. The substituent may be any substituent but an electron withdrawing substituent is preferred.

In Formula (1), $R^1$ is more preferably an electron withdrawing group or an aryl group.

The substituent represented by $R^2$ or $R^3$ in Formula (1) is preferably a group having the same meaning as the electron withdrawing group represented by Z in Formula (1), an alkyl group, a hydroxy group (or a salt thereof), a mercapto group (or a salt thereof), an alkoxy group, an aryloxy group, a heterocyclic oxy group, an alkylthio group, an arylthio group, a heterocyclic thio group, an amino group, an alkylamino group, an anilino group, a heterocyclic amino group, an acylamino group or a substituted or unsubstituted phenyl group.

In Formula (1), it is more preferred that one of $R^2$ and $R^3$ is a hydrogen atom and the other is substituent. The substituent is preferably an alkyl group, a hydroxy group (or a salt thereof), a mercapto group (or a salt thereof), an alkoxy group, an aryloxy group, a heterocyclic oxy group, an alkylthio group, an arylthio group, a heterocyclic thio group, an amino group, an alkylamino group, an anilino group, a heterocyclic amino group, an acylamino group (particularly, a perfluoroalkanamido group), a sulfonamido group, a substituted or unsubstituted phenyl group or a heterocyclic group, more preferably a hydroxy group (or a salt thereof), a mercapto group (or a salt thereof), an alkoxy group, an aryloxy group, a heterocyclic oxy group, an alkylthio group, an arylthio group, a heterocyclic thio group or a heterocyclic group, still more preferably a hydroxy group (or a salt thereof), an alkoxy group or a heterocyclic group.

In Formula (1), it is also preferred that Z and $R^1$ or $R^2$ and $R^3$ form a ring structure. The ring structure formed is a non-aromatic carbocyclic ring or a non-aromatic heterocyclic ring, preferably a 5-, 6- or 7-membered ring structure having a total carbon atom number including those of substituents of from 1 to 40, more preferably from 3 to 30.

The compound represented by Formula (1) is more preferably a compound where Z represents a cyano group, a formyl group, an acyl group, an alkoxycarbonyl group, an imino group or a carbamoyl group, $R^1$ represents an electron withdrawing group or an aryl group, and one of $R^2$ and $R^3$ represents a hydrogen atom and the other represents a hydroxy group (or a salt thereof), a mercapto group (or a salt thereof), an alkoxy group, an aryloxy group, a heterocyclic oxy group, an alkylthio group, an arylthio group, a heterocyclic thio group or a heterocyclic group, more preferably a compound where Z and $R^1$ form a non-aromatic 5-, 6- or 7-membered ring structure and one of $R^2$ and $R^3$ represents a hydrogen atom and the other represents a hydroxy group (or a salt thereof), a mercapto group (or a salt thereof), an alkoxy group, an aryloxy group, a heterocyclic oxy group, an alkylthio group, an arylthio group, a heterocyclic thio group or a heterocyclic group. At this time, Z which forms a non-aromatic ring structure together with $R^1$ is preferably an acyl group, a carbamoyl group, an oxycarbonyl group, a thiocarbonyl group or a sulfonyl group and $R^1$ is preferably an acyl group, a carbamoyl group, an oxycarbonyl group, a thiocarbonyl group, a sulfonyl group, an imino group, an imino group substituted by N atom, an acylamino group or a carbonylthio group.

The compound represented by Formula (2) is described below.

In Formula (2), $R^4$ represents a substituent. Examples of the substituent represented by $R^4$ include those described for the substituent represented by $R^1$, $R^2$ or $R^3$ in Formula (1).

The substituent represented by $R^4$ is preferably an electron withdrawing group or an aryl group. When $R^4$ represents an electron withdrawing group, the electron withdrawing group is preferably a group having a total carbon atom number of from 0 to 30 such as a cyano group, a nitro group, an acyl group, a formyl group, an alkoxycarbonyl group, an aryloxycarbonyl group, an alkylsulfonyl group, an arylsulfonyl group, a carbamoyl group, a sulfamoyl group, a trifluoromethyl group, a phosphoryl group, an imino group or a saturated or unsaturated heterocyclic group, more preferably a cyano group, an acyl group, a formyl group, an alkoxycarbonyl group, a carbamoyl group, a sulfamoyl group, an alkylsulfonyl group, an arylsulfonyl group or a heterocyclic group, still more preferably a cyano group, a formyl group, an acyl group, an alkoxycarbonyl group, a carbamoyl group or a heterocyclic group.

When $R^4$ represents an aryl group, the aryl group is preferably a substituted or unsubstituted phenyl group having a total carbon atom number of from 0 to 30. Examples of the substituent include those described for the substituent represented by $R^1$, $R^2$ or $R^3$ in Formula (1).

$R^4$ is more preferably a cyano group, an alkoxycarbonyl group, a carbamoyl group, a heterocylic group or a substituted or unsubstituted phenyl group, most preferably a cyano group, a heterocyclic group or an alkoxycarbonyl group.

The compound represented by Formula (3) is described in detail below.

In Formula (3), X and Y each independently represents a hydrogen atom or a substituent, and A and B each independently represents an alkoxy group, an alkylthio group, an alkylamino group, an aryloxy group, an arylthio group, an anilino group, a heterocyclic thio group, a heterocyclic oxy group or a heterocyclic amino group, and X and Y or A and B may be combined with each other to form a ring structure.

Examples of the substituent represented by X or Y in Formula (3) include those described for the substituent represented by $R^1$, $R^2$ or $R^3$ in Formula (1). Specific examples thereof include an alkyl group (including a perfluoroalkyl group and a trichloromethyl group), an aryl group, a heterocyclic group, a halogen atom, a cyano group, a nitro group, an alkenyl group, an alkynyl group, an acyl group, a formyl group, an alkoxycarbonyl group, an aryloxycarbonyl group, an imino group, an imino group substituted by N atom, a carbamoyl group, a thiocarbonyl group, an acyloxy group, an acylthio group, an acylamino group, an alkylsulfonyl group, an arylsulfonyl group, a sulfamoyl group, a phosphoryl group, a carboxy group (or a salt thereof), a sulfo group (or a salt thereof), a hydroxy group (or a salt thereof), a mercapto group (or a salt thereof), an alkoxy group, an aryloxy group, a heterocyclic oxy group, an alkylthio group, an arylthio group, a heterocyclic thio group, an amino group, an alkylamino group, an anilino group, a heterocyclic amino group and a silyl group.

These groups each may further have a substituent. X and Y may be combined with each other to form a ring structure and the ring structure formed may be either a non-aromatic carbocyclic ring or a non-aromatic heterocyclic ring.

In Formula (3), the substituent represented by X or Y is preferably a substituent having a total carbon number of from 1 to 40, more preferably from 1 to 30, such as a cyano group, an alkoxycarbonyl group, an aryloxycarbonyl group, a carbamoyl group, an imino group, an imino group substituted by N atom, a thiocarbonyl group, a sulfamoyl group, an alkylsulfonyl group, an arylsulfonyl group, a nitro group, a perfluoroalkyl group, an acyl group, a formyl group, a phosphoryl group, an acylamino group, an acyloxy group, an acylthio group, a heterocyclic group, an alkylthio group, an alkoxy group or an aryl group.

In Formula (3), X and Y each is more preferably a cyano group, a nitro group, an alkoxycarbonyl group, a carbamoyl group, an acyl group, a formyl group, an acylthio group, an acylamino group, a thiocarbonyl group, a sulfamoyl group, an alkylsulfonyl group, an arylsulfonyl group, an imino group, an imino group substituted by N atom, a phosphoryl group, a trifluoromethyl group, a heterocyclic group or a substituted phenyl group, still more preferably a cyano group, an alkoxycarbonyl group, a carbamoyl group, an alkylsulfonyl group, an arylsulfonyl group, an acyl group, an acylthio group, an acylamino group, a thicarbonyl group, a formyl group, an amino group, an imino group substituted by N atom, a heterocyclic group or a phenyl group substituted by any electron withdrawing group.

X and Y are also preferably combined with each other to form a non-aromatic carbocyclic ring or a non-aromatic heterocyclic ring. The ring structure formed is preferably a 5-, 6- or 7-membered ring having a total carbon atom number of from 1 to 40, more preferably from 3 to 30. X and Y for forming a ring structure each is preferably an acyl group, a carbamoyl group, an oxycarbonyl group, a thiocarbonyl group, a sulfonyl group, an imino group, an imino group substituted by N atom, an acylamino group or a carbonylthio group.

In Formula (3), A and B each independently represents an alkoxy group, an alkylthio group, an alkylamino group, an aryloxy group, an arylthio group, an anilino group, a heterocyclic thio group, a heterocyclic oxy group or a heterocyclic amino group, which may be combined with each other to form a ring structure. Those represented by A and B in Formula (3) are preferably a group having a total carbon atom number of from 1 to 40, more preferably from 1 to 30, and the group may further have a substituent.

In Formula (3), A and B are more preferably combined with each other to form a ring structure. The ring structure formed is preferably a 5-, 6- and 7-membered non-aromatic heterocyclic ring having a total carbon atom number of from 1 to 40, more preferably from 3 to 30. Examples of the linked structure (—A—B—) formed by A and B include —O—$(CH_2)_2$—O—, —O—$(CH_2)_3$—O—, —S—$(CH_2)_2$—S—, —S—$(CH_2)_3$—S—, —S—ph—S—, —N$(CH_3)$—$(CH_2)_2$—O—, —N$(CH_3)$—$(CH_2)_2$—S—, —O—$(CH_2)_2$—S—, —O—$(CH_2)_3$—S—, —N$(CH_3)$—ph—O—, —N$(CH_3)$—ph—S— and —N(ph)—$(CH_2)_2$—S—.

Into the compound represented by Formula (1), (2) or (3) for use in the present invention, an adsorptive group capable of adsorbing to silver halide may be integrated. Examples of the adsorptive group include the groups described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245 and JP-A-63-234246, such as an alkylthio group, an arylthio group, a thiourea group, a thioamide group, a mercaptoheterocyclic group and a triazole group. The adsorptive group to silver halide may be formed into a precursor. Examples of the precursor include the groups described in JP-A-2-285344.

Into the compound represented by Formula (1), (2) or (3) for use in the present invention, a ballast group or polymer commonly used in immobile photographic additives such as a coupler may be integrated, preferably a ballast group is incorporated. The ballast group is a group having 8 or more carbon atoms and being relatively inactive to the photographic properties. Examples of the ballast group include an alkyl group, an aralkyl group, an alkoxy group, a phenyl group, an alkylphenyl group, a phenoxy group and an alkylphenoxy group. Examples of the polymer include those described in JP-A-1-100530.

The compound represented by Formula (1), (2) and (3) for use in the present invention may contain a cationic group (specifically, a group containing a quaternary ammonio group or a nitrogen-containing heterocyclic group containing a quaternized nitrogen atom), a group containing an ethyleneoxy group or a propyleneoxy group as a repeating unit, an (alkyl, aryl or heterocyclic)thio group, or a dissociative group capable of dissociation by a base (e.g., carboxy group, sulfo group, acylsulfamoyl group, carbamoylsulfamoyl group), preferably a group containing an ethyleneoxy group or a propyleneoxy group as a repeating unit, or an (alkyl, aryl or heterocyclic)thio group. Specific examples of these groups include the compounds described in JP-A-7-234471, JP-A-5-333466, JP-A-6-19032, JP-A-6-19031, JP-A-5-45761, U.S. Pat. Nos. 4,994,365 and 4,988,604, JP-A-3-259240, JP-A-7-5610, JP-A-7-244348 and German Patent No. 4,006,032.

Specific examples of the compounds represented by Formulae (1) to (3) for use in the present invention are shown below. However, the present invention is by no means limited to the following compounds.

C-1

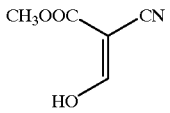

C-2

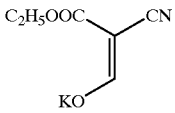

C-3

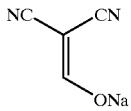

C-4

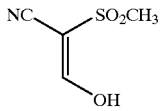

C-5

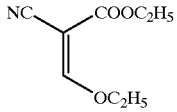

C-6

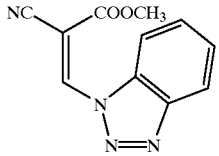

C-7

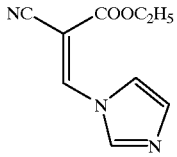

C-8

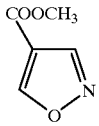

C-9

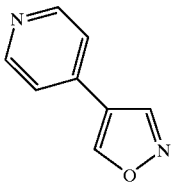

C-10

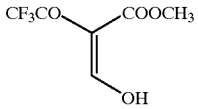

C-11

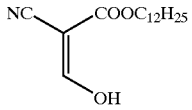

C-12

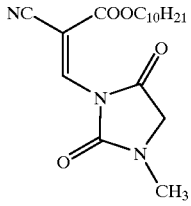

C-13

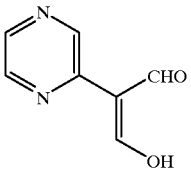

C-14

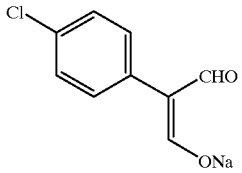

C-15

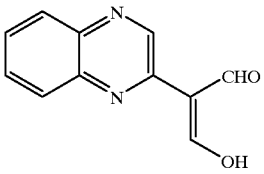

C-16

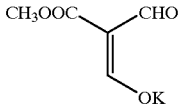

-continued
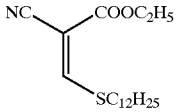
C-17
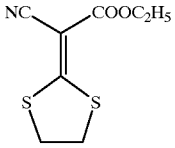
C-18
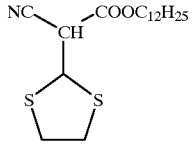
C-19
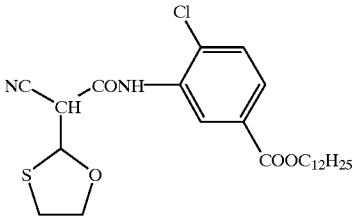
C-20
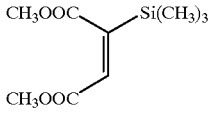
C-21
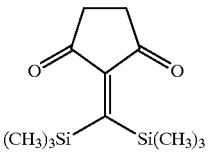
C-22
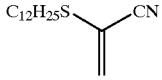
C-23
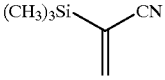
C-24
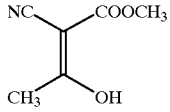
C-25
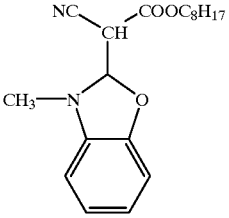
C-26
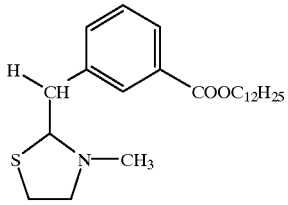
C-27
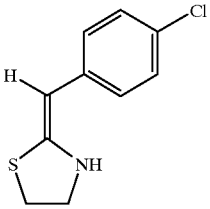
C-28
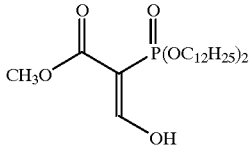
C-29
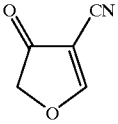
C-30
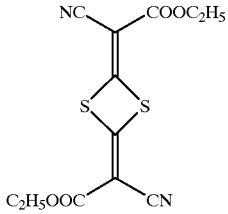
C-31
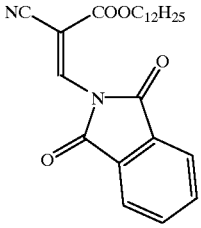
C-32

-continued
C-33
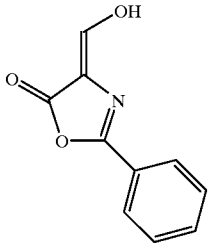
C-34
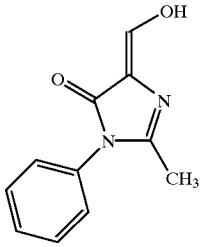
C-35
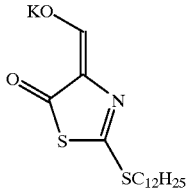
C-36
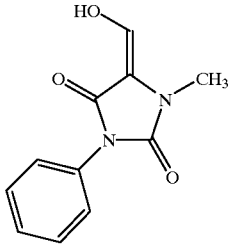
C-37
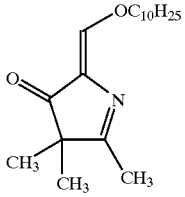
C-38
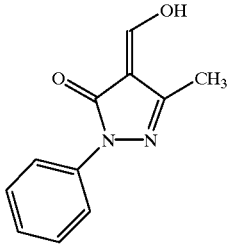
C-39
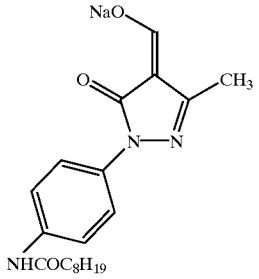
C-40
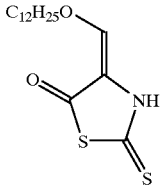
C-41
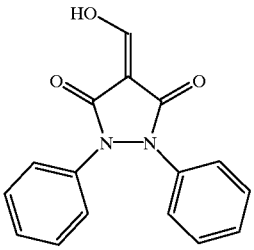
C-42
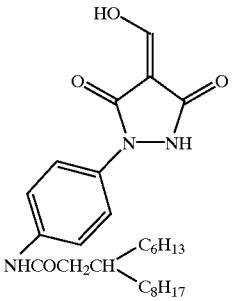

-continued
C-43
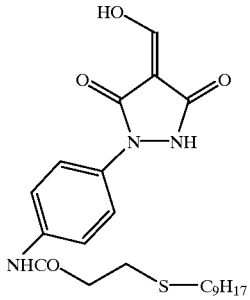
C-44
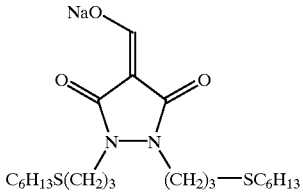
C-45
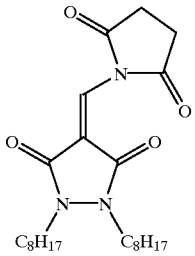
C-46
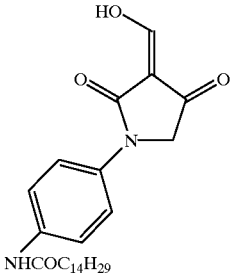
C-47
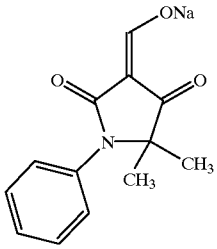
C-48
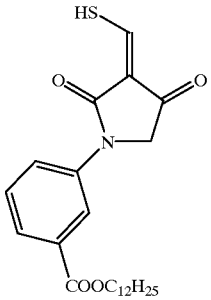
C-49
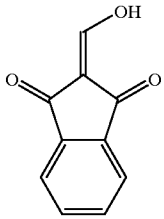
C-50
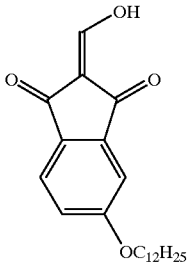
C-51
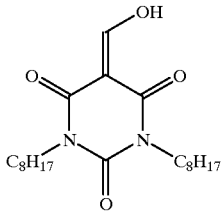
C-52
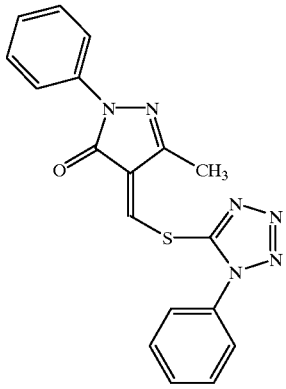

-continued
C-53
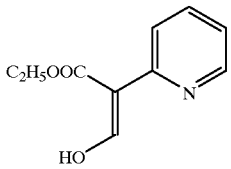
C-54
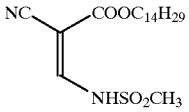
C-55
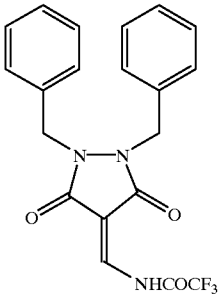
C-56
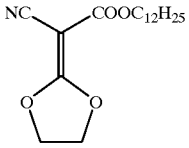
C-57
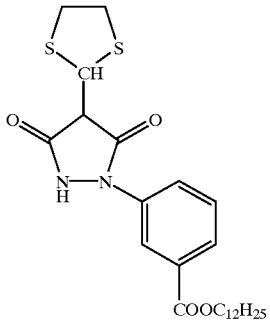
C-58
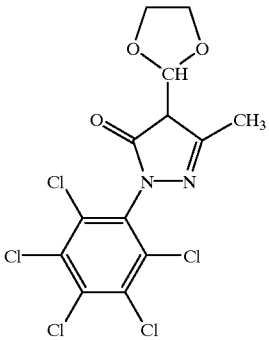
C-59
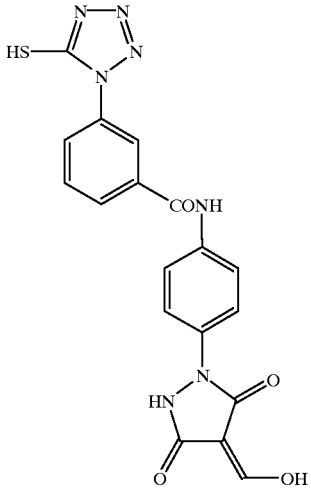
C-60
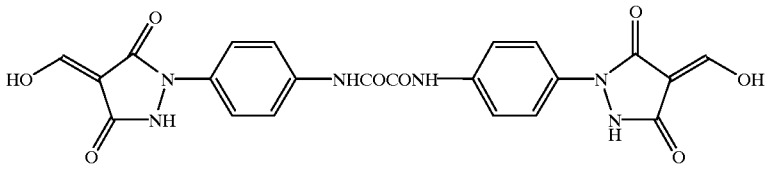

-continued

C-61

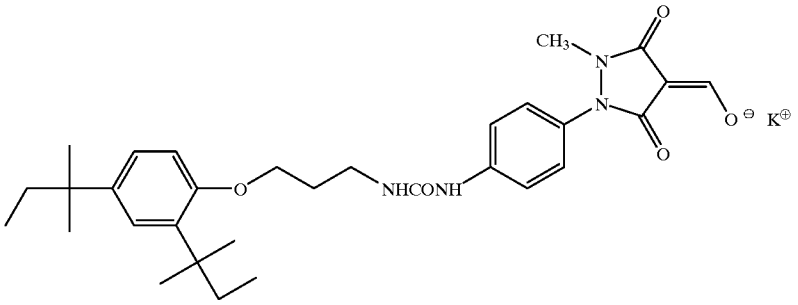

C-62

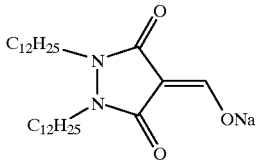

C-63

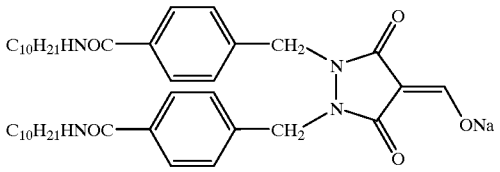

C-64

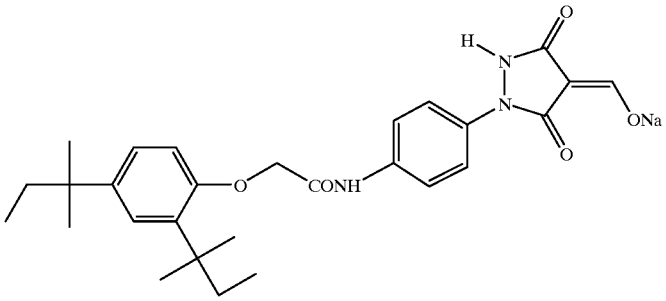

The compounds represented by Formulae (1) to (3) for use in the present invention each may be used after dissolving it in water or an appropriate organic solvent such as an alcohol (e.g., methanol, ethanol, propanol, fluorinated alcohol), a ketone (e.g., acetone, methyl ethyl ketone), dimethylformamide, dimethylsulfoxide or methyl cellosolve.

Also, the compounds represented by Formulae (1) to (3) for use in the present invention each may be dissolved by an already well-known emulsification dispersion method using an oil such as dibutyl phthalate, tricresyl phosphate, glyceryl triacetate or diethyl phthalate, or an auxiliary solvent such as ethyl acetate or cyclohexanone, and mechanically formed into an emulsified dispersion before use. Furthermore, the compounds represented by Formulae (1) to (3) each may be used after dispersing the powder of the compound in an appropriate solvent such as water by a method known as a solid dispersion method, using a ball mill, a colloid mill or an ultrasonic wave.

The compounds represented by Formulae (1) to (3) for use in the present invention each may be added to a layer in the image-recording layer side on the support, namely, an image-forming layer, or any other layers; however, the compounds each is preferably added to an image-forming layer or a layer adjacent thereto.

The addition amount of the compound represented by Formula (1), (2) or (3) for use in the present invention is preferably from $1\times10^{-6}$ to 1 mol, more preferably from $1\times10^{-5}$ to $5\times10^{-1}$ mol, most preferably from $2\times10^{-5}$ to $2\times10^{-1}$ mol, per mol of silver.

The compounds represented by formulae (1) to (3) can be easily synthesized according to known methods and may be synthesized by referring, for example, to U.S. Pat. Nos. 5,545,515, 5,635,339 and 5,654,130, International Patent Publication WO97/34196 or Japanese Patent Application Nos. 9-354107, 9-309813 and 9-272002.

The compounds represented by Formulae (1) to (3) may be used individually or in combination of two or more thereof. In addition to these compounds, a compound described in U.S. Pat. Nos. 5,545,515, 5,635,339 and 5,654,130, International Patent Publication WO97/34196, U.S. Pat. No. 5,686,228 or Japanese Patent Application Nos. 8-279962, 9-228881, 9-273935, 9-354107, 9-309813, 9-296174, 9-282564, 9-272002, 9-272003 and 9-332388 may also be used in combination. They can also be used in combination with such hydrazine derivatives as mentioned below.

For the invention, hydrazine derivatives may be used as a nucleation agent. The above nucleation agent and hydrazine derivatives can used concurrently. In such a case, the hydrazine derivatives described below may also be preferably used. The hydrazine derivatives used in this invention can be synthesized by various methods described in the following patent publications.

Examples of the hydrazine derivative other than the hydrazine derivative described in the foregoing include the compounds represented by (Chem. 1) of JP-B-6-77138, specifically, compounds described at pages 3 and 4 of the publication; the compounds represented by the formula (I) of JP-B-6-93082, specifically, Compounds 1–38 described at pages 8 to 18 of the publication; the compounds represented by the formulae (4), (5) and (6) of JP-A-6-230497, specifically, Compounds 4-1 to 4-10 described at pages 25 and 26, Compounds 5-1 to 5-42 described at pages 28 to 36 and Compounds 6-1 to 6-7 described at pages 39 and 40 of the publication; the compounds represented by the formulae (1) and (2) of JP-A-6-289520, specifically, Compounds 1-1) to 1-17) and 2-1) described at pages 5 to 7 of the publication; the compounds represented by (Chem. 2) and (Chem. 3) of JP-A-6-313936, specifically, compounds described at pages 6 to 19 of the publication; the compound represented by (Chem. 1) of JP-A-6-313951, specifically, the compounds described at pages 3 to 5 of the publication; the compound represented by the formula (I) of JP-A-7-5610, specifically, Compounds I-1 to I-38 described at pages 5 to 10 of the publication; the compounds represented by the formula (II) of JP-A-7-77783, specifically, Compounds II-1 to II-102 described at pages 10 to 27 of the publication; the compounds represented by the formula (H) and (Ha) of JP-A-7-104426, specifically, Compounds H-1 to H-44 described at pages 8 to 15 of the publication; the compounds characterized by having in the vicinity of the hydrazine group an anionic group or a nonionic group capable of forming an internal hydrogen bond with a hydrogen atom of hydrazine, described in JP-A-9-22082, particularly, the compounds represented by the formulae (A), (B), (C), (D), (E) and (F), specifically, Compounds N-1 to N-30 described in the publication; the compound represented by the formula (1) described in JP-A-9-22082, specifically, Compounds D-1 to D-55 described in the publication; various hydrazine derivatives described at pages 25 to 34 of *Kochi Gijutsu* (*Known Techniques*), pages 1 to 207, Aztech (issued on Mar. 22, 1991); and Compounds D-2 and D-39 described in JP-A-62-86354 (pages 6 and 7).

The hydrazine derivatives for use in the present invention may be used after dissolving it in an appropriate organic solvent such as an alcohol (e.g., methanol, ethanol, propanol, fluorinated alcohol), a ketone (e.g., acetone, methyl ethyl ketone), dimethylformamide, dimethylsulfoxide or methyl cellosolve.

Also, the hydrazine derivatives for use in the present invention each may be dissolved by an already well-known emulsification dispersion method using an oil such as dibutyl phthalate, tricresyl phosphate, glyceryl triacetate or diethyl phthalate, or an auxiliary solvent such as ethyl acetate or cyclohexanone, and mechanically formed into an emulsified dispersion before use. Furthermore, they may be used after dispersing the powder of the hydrazine derivative in water by a method known as a solid dispersion method, using a ball mill, colloid mill or ultrasonic wave.

The hydrazine derivatives for use in the present invention may be used to any layers on the image-forming layer side on the support, i.e., the image-forming layer or other layers on that layer side; however, they are preferably added to an image-forming layer or a layer adjacent thereto.

The addition amount of the hydrazine derivatives for use in the present invention is preferably from $1\times10^{-6}$ to $1\times10^{-2}$ mol, more preferably from $1\times10^{-5}$ to $5\times10^{-3}$ mol, most preferably from $2\times10^{-5}$ to $5\times10^{-3}$ mol, per mol of silver.

In the present invention, a nucleation agent may be used in combination with the above-described ultrahigh contrast agent so as to form an ultrahigh contrast image. Examples thereof include amine compounds described in U.S. Pat. No. 5,545,505, specifically, AM-1 to AM-5; hydroxamic acids described in U.S. Pat. No. 5,545,507, specifically, HA-1 to HA-11; acrylonitriles described in U.S. Pat. No. 5,545,507, specifically, CN-1 to CN-13, hydrazine compounds described in U.S. Pat. No. 5,558,983, specifically, CA-1 CA-6; and onium salts described in JP-A-9-297368, specifically, A-1 to A-42, B-1 to B-27 and C-1 to C-14.

The synthesis methods, addition methods and addition amounts of the aforementioned ultrahigh contrast agents and the contrast accelerators may be according to those described in the patent publications cited above.

For this invention, it is preferably to use an acid created from diphosphorus pentaoxide upon hydration or its salt together with the nulceation agent. As such as acid created from diphosphorus pentaoxide upon hydration or its salt, metaphosphoric acid (metaphosphate), pyrophosphoric acid (pyrophosphate), orthophosphoric acid (orthophosphate), triphosphoric acid (triphosphate), tetraphosphoric acid (tetraphosphate), hexametaphosphoric acid (hexametaphosphate), and so on are exemplified. As such as acid created from diphosphorus pentaoxide upon hydration or its salt used particularly preferably, orthophosphoric acid (orthophosphate), and hexametaphosphoric acid (hexametaphosphate) are exemplified, and more specifically, sodium orthophosphoric acid, sodium dihydrogen orthophosphoric acid, sodium hexamethaphosphoric acid, ammonium hexametaphosphoric acid, and so no are exemplified.

The acid created from diphosphorus pentaoxide upon hydration or its salt used preferably in this invention is added to the image forming layer or a binder layer adjacent thereto because bringing desired effects even in a small amount.

The use amount (coating amount per $m^2$ of photosensitive material) of the acid created from diphosphorus pentaoxide upon hydration or its salt used in this invention can be a prescribed amount according to the performance such as the sensitivity or the fog, and a preferably use amount is 0.1 to 500 $mg/m^2$, and more preferably, 0.5 to 100 $mg/m^2$.

The heat developable photosensitive material of the present invention contains a reducing agent for organic silver salt. The reducing agent for organic silver salt may be any substance, preferably an organic substance, which reduces the silver ion to metal silver. Conventional photographic developers such as phenidone, hydroquinone and catechol are useful, but a hindered phenol reducing agent is preferred. The reducing agent is preferably contained in an amount of from 5 to 50% by mol, more preferably from 10 to 40% by mol, per mol of silver on the surface having an image-forming layer. The layer to which the reducing agent is added may be any layer on the surface having an image-forming layer. In the case of adding the reducing agent to a layer other than the image-forming layer, the reducing agent is preferably used in a slightly large amount of from 10 to 50% by mol per mol of silver. The reducing agent may also be a so-called precursor which is derived to effectively exhibit the function only at the time of development.

For the heat-developable photosensitive material using an organic silver salt, reducing agents over a wide range are known and these are disclosed in JP-A-46-6074, JP-A-47-1238, JP-A-47-33621, JP-A-49-46427, JP-A-49-115540, JP-A-50-14334, JP-A-50-36110, JP-A-50-147711, JP-A-51-32632, JP-A-51-1023721, JP-A-51-32324, JP-A-51-51933, JP-A-52-84727, JP-A-55-108654, JP-A-56-146133, JP-A-57-82828, JP-A-57-82829, JP-A-6-3793, U.S. Pat. Nos. 3,667,9586, 3,679,426, 3,751,252, 3,751,255, 3,761,270, 3,782,949, 3,839,048, 3,928,686 and 5,464,738, German Patent No. 2,321,328, European Patent 692732 and the like. Examples thereof include amidoximes such as phenylamidoxime, 2-thienylamidoxime and p-phenoxyphenylamidoxime; azines such as 4-hydroxy-3,5-dimethoxybenzaldehyde azine; combinations of an aliphatic carboxylic acid arylhydrazide with an ascorbic acid such as a combination of 2,2-bis(hydroxymethyl)propionyl-β-phenylhydrazine with an ascorbic acid; combinations of polyhydroxybenzene with hydroxylamine, reductone and/or hydrazine such as a combination of hydroquinone with bis(ethoxyethyl)hydroxylamine, piperidinohexose reductone or formyl-4-methylphenylhydrazine; hydroxamic acids such as phenylhydroxamic acid, p-hydroxyphenylhydroxamic acid and β-anilinehydroxamic acid; combinations of an azine with a sulfonamidophenol such as a combination of phenothiazine with 2,6-dichloro-4-benzenesulfonamidophenol; α-cyanophenylacetic acid derivatives such as ethyl-α-cyano-2-methylphenylacetate and ethyl-α-cyanophenylacetate; bis-β-naphthols such as 2,2-dihydroxy-1,1-binaphthyl, 6,6-dibromo-2,2-dihydroxy-1,1-binaphthyl and bis(2-hydroxy-1-naphthyl)methane; combinations of a bis-β-naphthol with a 1,3-dihydroxybenzene derivative (e.g., 2,4-dihydroxybenzophenone, 2,4-dihydroxyacetophenone); 5-pyrazolones such as 3-methyl-1-phenyl-5-pyrazolone; reductones such as dimethylaminohexose reductone, anhydrodihydroaminohexose reductone and anhydrodiydropiperidonehexose reductone; sulfonamidophenol reducing agents such as 2,6-dichloro-4-benzenesulfonamidophenol and p-benzenesulfonamidophenol; 2-phenylindane-1,3-diones; chromans such as 2,2-dimethyl-7-t-butyl-6-hydroxychroman; 1,4-dihydropyridines such as 2,6-dimethoxy-3,5-dicarboethoxy-1,4-dihydropyridine; bisphenols such as bis(2-hydroxy-3-t-butyl-5-methylphenyl)methane, 2,2-bis(4-hydroxy-3-methylphenyl) propane, 4,4-ethylidene-bis(2-t-butyl-6-methylphenol), 1,1-bis(2-hydroxy-3,5-dimethylphenyl)-3,5,5-trimethylhexane and 2,2-bis(3,5-dimethyl-4-hydroxyphenyl)propane; ascorbic acid derivatives such as 1-ascorbyl palmitate and ascorbyl stearate; aldehydes and ketones such as benzyl and biacetyl; 3-pyrazolidone and a certain kind of indane-1,3-diones; and chromanols such as tocopherol. Particularly preferred reducing agents are bisphenols and chromanols.

The reducing agent of the present invention may be added in any form of a solution, powder and a solid microparticle dispersion. The solid microparticle dispersion is performed using a known pulverizing means (e.g., ball mill, vibrating ball mill, sand mill, colloid mill, jet mill, roller mill). At the time of solid microparticle dispersion, a dispersion aid may also be used.

When an additive known as a "color toner" capable of improving the image is added, the optical density increases in some cases. Also, the color toner is advantageous in forming a black silver image depending on the case. The color toner is preferably contained on the surface having an image-forming layer in an amount of from 0.1 to 50% by mol, more preferably from 0.5 to 20% by mol, per mol of silver. The color toner may be a so-called precursor which is derived to effectively exhibit the function only at the time of development.

For the heat-developable photosensitive material using an organic silver salt, color toners over a wide range are known and these are disclosed in JP-A-46-6077, JP-A-47-10282, JP-A-49-5019, JP-A-49-5020, JP-A-49-91215, JP-A-49-91215, JP-A-50-2524, JP-A-50-32927, JP-A-50-67132, JP-A-50-67641, JP-A-50-114217, JP-A-51-3223, JP-A-51-27923, JP-A-52-14788, JP-A-52-99813, JP-A-53-1020, JP-A-53-76020, JP-A-54-156524, JP-A-54-156525, JP-A-61-183642, JP-A-4-56848, JP-B-49-10727, JP-B-54-20333, U.S. Pat. Nos. 3,080,254, 3,446,648, 3,782,941, 4,123,282 and 4,510,236, British Patent No. 1,380,795 and Belgian Patent No. 841910. Examples of the color toner include phthalimide and N-hydroxyphthalimide; succinimide, pyrazolin-5-ones and cyclic imides such as quinazolinone, 3-phenyl-2-pyrazolin-5-one, 1-phenylurazole, quinazoline and 2,4-thiazolidinedione; naphthalimides such as N-hydroxy-1,8-naphthalimide; cobalt complexes such as cobalt hexaminetrifluoroacetate; mecarptanes such as 3-mercapto-1,2,4-triazole, 2,4-dimercaptopyrimidine, 3-mercapto-4,5-diphenyl-1,2,4-triazole and 2,5-dimercapto-1,3,4-thiadiazole; N-(aminomethyl)aryldicarboxyimides such as N,N-(dimethylaminomethyl)phthalimide and N,N-(dimethylaminoethyl)naphthalene-2,3-dicarboxyimide; blocked pyrazoles, isothiuronium derivatives and a certain kind of photobleaching agents, such as N,N'-hexamethylenebis(1-carbamoyl-3,5-dimethylpyrazole), 1,8-(3,6-diazaoctane)bis(isothiuroniumtrifluoroacetate) and 2-(tribromomethylsulfonyl)benzothiazole; 3-ethyl-5-[(3-ethyl-2-benzothiazolinylidene)-1-methylethylidene]-2-thio-2,4-oxazolidinedione; phthalazinone, phthalazinone derivatives and metal salts thereof, such as 4-(1-naphthyl) phthalazinone, 6-chlorophthalazinone, 5,7-dimethyloxyphthalazinone or 2,3-dihydro-1,4-phthalazinedione; combinations of phthalazinone with a phthalic acid derivative (e.g., phthalic acid, 4-methylphthalic acid, 4-nitrophthalic acid, tetrachlorophthalic acid anhydride); phthalazine, phthalazine derivatives (e.g., 4-(1-naphthyl)phthalazine, 6-chlorophthalazinone, 5,7-dimethoxyphthalazine, 2,3-dihydrophthalazine) and metal salts thereof; combinations of a phthalazine and a phthalic acid derivative (e.g., phthalic acid, 4-methylphthalic acid, 4-nitrophthalic acid, tetrachlorophthalic acid anhydride), quinazolinedione, benzoxazine and naphthoxazine derivatives; rhodium complexes which function not only as a color toner but also as a halide ion source for the formation of silver halide at the site, such as ammonium hexachlororhodate(III), rhodium bromide, rhodium nitrate and potassium hexachlororhodate(III); inorganic peroxides and persulfates such as ammonium disulfide peroxide and hydrogen peroxide; benzoxazine-2,4-diones such as 1,3-benzoxazin-2,4-dione, 8-methyl-1,3-benzoxazin-2,4-dione, and 6-nitro-1,3-benzoxazin-2,4-dione; pyrimidines and asymmetric triazines such as 2,4-dihydroxypyrimidine and 2-hydroxy-4-aminopyrimidine; and azauracil and tetraazapentalene derivatives such as 3,6-dimercapto-1,4-diphenyl-1H,4H-2,3a,5,6a-tetraazapentalene and 1,4-di(o-chlorophenyl)-3,6-dimercapto-1H,4H-2,3a,5,6a-tetraazapentalene.

The color toner of the present invention may be added in any form of a solution, powder, solid microparticle dispersion and the like. The solid fine particle dispersion is performed using a known pulverization means (e.g., ball mill, vibrating ball mill, sand mill, colloid mill, jet mill, roller mill). At the time of solid microparticle dispersion, a dispersion aid may also be used.

The pH of the film surface before heat development processing of the heat developable photosensitive material according to the invention is preferably 6 or less to reduce fog during preservation, more preferably 5.5 or less, and further more preferably, 5.3 or less. There is no special lower limitation but is may be around 3.

Controlling of the film surface pH preferably uses an organic acid such as phthalic acid derivatives, an non-volatile acid such as a sulfuric acid, and a volatile base such as an ammonia, from a viewpoint to reduce the film surface pH. Particularly, since ammonia is ready to be volatile and can be eliminated before the coating step or before thermally heated, ammonia is preferably to achieve a lower film surface pH.

To measure the film surface pH of the heat developable photosensitive material of the invention, the heat developable photosensitive material before heat development processing is folded into a boat shape in 2.5 cm×2.5 cm; a distilled water of 300 μl is dropped on a side of the image forming layer. After calmly placed for 30 minutes, the dropped liquid is preferably measured for one minute with pH BOY-P2 (made by Shin Dengen Kogyo K. K., pH measurer of a semiconductor system).

As a binder for this invention, polymer latexes as described below are preferably used. At least one layer among image forming layers containing the photosensitive silver halide of the heat developable photosensitive material of the invention is preferably an image forming layer containing the following polymer latex at least 50% by weight of the entire binders. Hereinafter, this image forming layer is referred to as "an image forming layer of the invention," and the polymer latex is referred to as "a polymer latex of the invention." The polymer latex can be used not only for the image forming layer but also for the protection layer and the back layer. Particularly, when the heat developable photosensitive material of the invention is used for the printing purpose in which size deviation is concerned, it is preferable to use the polymer latex in the protection layer and the back layer. However, "the polymer latex" herein indicates water-insoluble hydrophobic polymer as fine particles dispersed in a water-soluble dispersion medium. With respect to the dispersion state, the polymer may be emulsified in the dispersion medium, emulsion-polymerized or micell dispersed or the polymer may have a partially hydrophilic structure in the polymer molecule so that the molecular chain itself is dispersed in the molecule. The polymer latex for use in the present invention is described in Gosei Jushi Emulsion (Synthetic Resin Emulsion), compiled by Taira Okuda and Hiroshi Inagaki, issued by Kobunshi Kanko Kai (1978), Gosei Latex no Oyo (Application of Synthetic Latex), compiled by Takaaki Sugimura, Yasuo Kataoka, Souichi Suzuki and Keishi Kasahara, issued by Kobunshi Kanko Kai (1993), and Soichi Muroi, Gosei Latex no Kagaku (Chemistry of Synthetic Latex), Kobunshi Kanko Kai (1970) and the like. The dispersion particles preferably have an average particle size of from 1 to 50,000 nm, more preferably on the order of from 5 to 1,000 nm. The particle size distribution of the dispersed particles is not particularly limited, and the dispersed particles may have a broad particle size distribution or a monodisperse particle size distribution.

As the polymer latex used for the present invention, a so-called core/shell type latex may be used other than the normal polymer latex having a uniform structure. In this case, it is preferred in some cases that the core and the shell have different glass transistion temperatures.

The polymer latex used as the binder in the present invention has a glass transition temperature (Tg) of which preferred range may be different among those for the protection layer, the back layer and the image-forming layer. In the image-forming layer, the glass transistion temperature is preferably from −30° C. to 40° C., to promote the diffusion of the photographically useful materials during the heat development. In the protection layer and the back layer, the glass transition temperature is preferably 25° C. to 70° C. because the protection layer and the back layer are brought into contact with various instruments.

The polymer latex for use in the present invention preferably has a minimum film-forming temperature (MFT) of from −30 to 90° C., more preferably from 0 to 70° C. In order to control the minimum film-forming temperature, a film-forming aid may be added. The film-forming aid is also called a particular and it is an organic compound (usually an organic solvent) capable of reducing the minimum film-forming temperature of the polymer latex. This organic compound is described in Souichi Muroi, Gosei Latex no Kagaku (Chemistry of Synthetic Latex), Kobunshi Kanko Kai (1970), ibid.

The polymer species of the polymer latex for use in the present invention may be of acrylic resin, vinyl acetate resin, polyester resin, polyurethane resin, rubber-based resin, vinyl chloride resin, vinylidene chloride resin, polyolefin resin or a copolymer thereof. The polymer may be a straight-chained polymer, a branched polymer or a cross-linked polymer. The polymer may be a so-called homopolymer obtained by polymerizing a single kind of monomers or may be a copolymer obtained by polymerizing two or more kinds of monomers. The copolymer may be either a random copolymer or a block copolymer. The polymer preferably has a number average molecular weight of from 5,000 to 1,000,000, more preferably on the order of from 10,000 to 100,000. If the molecular weight is too small, the image-forming layer is deficient in the mechanical strength, whereas if it is excessively large, the film-forming property is disadvantageously poor.

Specific examples of the polymer latex used as a binder in the image forming layer of the heat developable photosensitive material of the present invention include a methyl methacrylate/ethyl acrylate/methacrylic acid copolymer latex, methyl methacrylate/2-ethylhexyl acrylate/hydroxyethyl methyacrylate/styrene/acrylic acid copolymer latex, styrene/butadiene/acrylic acid copolymer latex, styrene/butadiene/divinylbenzene/methylacrylic acid copolymer latex, methyl methacrylate/vinyl chloride/acrylic acid copolymer latex and vinylidene chloride/ethyl acrylate/acrylonitrile/methylacrylic acid copolymer latex. Such polymers are also commercially available and examples of the polymer which can be used include acrylic resins such as CEBIAN A-4635, 46583, 4601 (all produced by Dicel Kagaku Kogyo Co., Ltd), Nipol Lx811, 814, 821, 857, 857x2 (all produced by Nippon Zeon Co., Ltd); polyester resins such as FINETEX ES650, 611, 675, 850 (all produced by Dai-Nippon Ink & Chemicals, Inc.), WD-size and WMS (both produced by Eastman Chemical); polyurethane resins such as HYDRAN AP10, 20, 30, 40 (all produced by Dai-Nippon Ink & Chemicals, Inc.); rubber-based resins such as LACSTAR 7310K, 3307B, 4700H, 7132C (all produced by Dai-Nippon Ink & Chemicals, Inc.), Nipol Lx416, 410, 438C, 2507 (all produced by Nippon Zeon Co., Ltc.); vinyl chloride resins such as G351, G576 (both produced by Nippon Zeon Co., Ltd.); vinylidene chloride resins such as L502, L513 (both produced by Asahi Chemical Industry Co., Ltd.), ARON D7020, D504, D5071 (all produced by Mitsui Petrochemical Industries, Ltd.); and olefin resins such as CHEMIPEARL S120 and SA100 (both produced by Mitsui Petrochemical Industries, Ltd.) and the like. These polymers may be used individually or if desired, as a blend of two or more thereof.

The image forming layer of the invention is preferably structured to include the polymer latex having 50% by weight of the entire binder, more preferably, 70% by weight.

The image forming layer of the invention may contain a hydrophilic polymer, if desired, in an amount of less than 50% by weight of the entire binder, such as gelatin, polyvinyl alcohol, methyl cellulose, hydroxypropyl cellulose, carboxymethyl cellulose and hydroxypropylmethyl cellulose. The amount of the hydrophilic polymer added is preferably 30% by weight or less of the entire binder in the image-forming layer, more preferably, 15% by weight.

The image forming layer of the present invention is preferably formed by coating an aqueous coating solution and then drying it. The term "aqueous" as used herein means that 60% by weight or more of the solvent (dispersion medium) in the coating solution is composed of water. The component other than water of the coating solution may be a water-miscible organic solvent such as methyl alcohol, ethyl alcohol, isopropyl alcohol, methyl cellusolve, ethyl cellusolve, dimethylformamide, and ethyl acetate. As a detailed solvent composition, the followings can be exemplified: water/methanol=90/10, water/methanol=70/30, water/ethanol=90/10, water/isopropanol=90/10, water/dimethylformamide=95/5, water/methanol/dimethylformamide=80/15/5, water/methanol/dimethylformamide=90/5/5 (the number indicates percent by weight).

The total binder amount of the image forming layer of the invention is 0.2 to 30 g/m$^2$, more preferably 1 to 15 m$^2$. A crosslinking agent for crosslinking and a surfactant for improving coating capability or the like can be added to the image forming layer of the invention.

The heat developable photosensitive material of the present invention may contain a sensitizing dye. The sensitizing dye may be any one of those that can spectrally sensitize the halogenated silver halide particles at a desired wavelength region when they are adsorbed on the halogenated silver halide particles. As such sensitizing dyes, usable are, for example, cyanine dyes, merocyanine dyes, complex cyanine dyes, complex merocyanine dyes, holopolar cyanine dyes, styryl dyes, hemicyanine dyes, oxonole dyes and hemioxonole dyes. Sensitizing dyes which are usable in the present invention are described, for example, in Research Disclosure, Item 17643, IV-A (December, 1978, page 23), Item 183IX (August, 1978, page 437) and also in the reference as referred to in them. In particular, sensitizing dyes having a color sensitivity suitable for spectral characteristics of light sources of various laser imagers, scanners, image setters, process cameras and the like can advantageously be selected.

Exemplary dyes for spectral sensitization to so-called red light from light sources such as He—Ne laser, red semiconductor laser, and LED include Compounds I-1 to I-38 disclosed in JP-A-54-18726, Compounds I-1 to I-35 disclosed in JP-A-6-75322, Compounds I-1 to I-34 disclosed in JP-A-7-287338, Dyes 1 to 20 disclosed in JP-B-55-39818, Compounds I-1 to I-37 disclosed in JP-A-62-284343, and Compounds I-1 to I-34 disclosed in JP-A-7-287338.

Spectral sensitization as to the wavelength region of from 750 to 1,400 nm from semiconductor laser light sources can advantageously be obtained with various known dyes such as a cyanine dye, a merocyanine dye, a styryl dye, a hemicyanine dye, an oxonol dye, a hemioxonol dye and a xanthene dye. Useful cyanine dyes are cyanine dyes having a basic nucleus such as thiazoline nucleus, oxazoline nucleus, pyrroline nucleus, pyridine nucleus, oxazole nucleus, thiazole nucleus, selenazole nucleus or imidazole nucleus. Useful merocyanine dyes are merocyanine dyes having the above-described basic nucleus or an acidic nucleus such as thiohydantoin nucleus, rhodanine nucleus, oxazolidinedione nucleus, thiazolinedione nucleus, barbituric acid nucleus, thiazolinone nucleus, malononitrile nucleus or pyrazolone nucleus. Of these cyanine and merocyanine dyes, those having an imino group or a carboxyl group are particularly effective. The dye may be appropriately selected from known dyes described, for example, in U.S. Pat. Nos. 3,761,279, 3,719,495 and 3,877,943, British Patent Nos. 1,446,201, 1,469,117 and 1,422,057, JP-B-3-10391, JP-B-6-52387, JP-A-5-341432, JP-A-6-194781 and JP-A-6-301141.

The dyes particularly preferably used for the present invention are cyanine dyes having a thioether bond (e.g., cyanine dyes described in JP-A-62-58239, JP-A-3-138638, JP-A-3-138642, JP-A-4-255840, JP-A-5-72659, JP-A-5-72661, JP-A-6-222491, JP-A-2-230506, JP-A-6-258757, JP-A-6-317868, JP-A-6-324425, JP-W-A-7-500926 (the code "JP-W-A" as used herein means an "international application published in Japanese for Japanese national phase"), and U.S. Pat. No. 5,541,054), dyes having a carboxylic acid group (e.g., dyes disclosed in JP-A-3-163440, JP-A-6-301141, and U.S. Pat. No. 5,441,899), merocyanine dyes, polynuclear merocyanine dyes and polynuclear cyanine dyes (dyes disclosed in JP-A-47-6329, JP-A-49-105524, JP-A-51-127719, JP-A-52-80829, JP-A-54-61517, JP-A-59-214846, JP-A-60-6750, JP-A-63-159841, JP-A-6-35109, JP-A-6-59381, JP-A-7-146537, JP-A-7-146537, JP-A-W-55-50111, British Patent No. 1,467,638, and U.S. Pat. No. 5,281,515) and the like.

Dyes forming J-band have been disclosed in U.S. Pat. Nos. 5,510,236, 3,871,887 (Example 5), JP-A-2-96131, JP-A-59-48753 and the like, and they can preferably be used for the present invention.

These sensitizing dyes may be used either individually or in combination of two or more thereof. The combination of sensitizing dyes is often used for the purpose of supersensitization. In combination with the sensitizing dye, a dye which itself has no spectral sensitization effect or a material which absorbs substantially no visible light, but which exhibits supersensitization may be incorporated into the emulsion. Useful sensitizing dyes, combinations of dyes which exhibit supersensitization, and materials which show supersensitization are described in Research Disclosure, Vol. 176, 17643, page 23, Item IV-J (December, 1978), JP-B-49-25500, JP-B-43-4933, JP-A-59-19032, JP-A-59-192242 and the like.

The sensitizing dyes may be used in combination of two or more of them for the present invention. The sensitizing dye may be added to the silver halide emulsion by dispersing it directly in the emulsion or may be added to the emulsion after dissolving it in a solvent such as water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol and N,N-dimethylformamide, and the solvent may be a sole solvent or a mixed solvent.

Furthermore, the sensitizing dye may be added using a method disclosed in U.S. Pat. No. 3,469,987 where a dye is dissolved in a volatile organic solvent, the solution is dispersed in water or hydrophilic colloid, and the dispersion is added to an emulsion, a method disclosed in JP-B-44-23389, JP-B-44-27555 and JP-B-57-22091 where a dye is dissolved in an acid and the solution is added to an emulsion or the solution is formed into an aqueous solution while allowing the presence together of an acid or base and then added to an emulsion, a method disclosed in U.S. Pat. Nos. 3,822,135 and 4,006,025 where an aqueous solution or colloid dispersion of a dye is formed in the presence of a surface active agent and the solution or dispersion is added to an emulsion, a method disclosed in JP-A-53-102733 and JP-A-58-105141 where a dye is dissolved directly in hydrophilic colloid and the dispersion is added to an emulsion, or a method disclosed in JP-A-51-74624 where a dye is dissolved using a compound capable of red shifting and the solution is added to an emulsion. An ultrasonic wave may also be used in dissolving the dye.

The sensitizing dye for use in the present invention may be added to a silver halide emulsion for use in the present invention in any step heretofore known to be useful in the preparation of an emulsion. The sensitizing dye may be added in any time period or step before the coating of the emulsion, for example, in the grain formation process of silver halide and/or before desalting or during the desalting process and/or the time period from desalting until initiation of chemical ripening, as disclosed in U.S. Pat. Nos. 2,735,766, 3,628,960, 4,183,756 and 4,225,666, JP-A-58-184142 and JP-A-60-196749, or immediately before or during the chemical ripening process or in the time period after chemical ripening until coating, as disclosed in JP-A-58-113920. Furthermore, as disclosed in U.S. Pat. No. 4,225,666 and JP-A-58-7629, the same compound by itself may be added in parts or a compound in combination with another compound having a different structure may be added in parts, for example, one part is added during grain formation and another part is added during or after chemical ripening, or one part is added before or during chemical ripening and another part is added after completion of the chemical ripening, and when the compound is added in parts, the combination of the compound added in parts with another compound may also be changed.

The amount of the sensitizing dye used in the present invention may be selected according to the performance such as sensitivity or fog; however, it is preferably from $10^{-6}$ to 1 mol, more preferably from $10^{-4}$ to $10^{-1}$ mol, per mol of silver halide in the photosensitive layer.

To improve an infrared spectrum sensitizing efficient, a supersensitizing agent can be used. As the supersensitizing agent used in the invention, exemplified are compounds disclosed in European Patent No. 587,338, U.S. Pat. No. 3,877,943, and U.S. Pat. No. 4,873,184, complex aromatic or aliphatic mercapto compounds, complex aromatic disulfide compounds, stilbene, hydrazine, and triazine.

Particularly preferable supersensitizing agents are a complex aromatic mercapto compound as disclosed in JP-A-5-341,432, a complex aromatic disulfide compound, a stilbene compound as disclosed in JP-A-10-73899, and a compound as represented by Formula (1) as set forth in Japanese Patent Application No. 10-78168, more specifically, compounds 1 to 57 as set forth in the specification of the Application.

The adding amount of the supersensitizing agent such as a mercapto compound is preferably from 0.0001 to 1.0 mol, more preferably from 0.001 to 0.3 mol, per mol of silver in an emulsion layer.

The silver halide emulsion and/or organic silver salt for use in the present invention can be further prevented from the production of additional fog or stabilized against the reduction in sensitivity during the stock storage, by an antifoggant, a stabilizer or a stabilizer precursor. Examples of antifoggants, stabilizers and stabilizer precursors which can be appropriately used individually or in combination include thiazonium salts described in U.S. Pat. Nos. 2,131,038 and 2,694,716, azaindenes described in U.S. Pat. Nos. 2,886,437 and 2,444,605, mercury salts described in U.S. Pat. No. 2,728,663, urazoles described in U.S. Pat. No. 3,287,135, sulfocatechol described in U.S. Pat. No. 3,235,652, oximes, nitrons and nitroindazoles described in British Patent No. 623,448, polyvalent metal salts described in U.S. Pat. No. 2,839,405, filed thiuronium salts described in U.S. Pat. No. 3,220,839, palladium, platinum and gold salts described in U.S. Pat. Nos. 2,566,263 and 2,597,915, halogen-substituted organic compounds described in U.S. Pat. Nos. 4,108,665 and 4,442,202, triazines described in U.S. Pat. Nos. 4,128,557, 4,137,079, 4,138,365 and 4,459,350, and phosphorus compounds described in U.S. Pat. No. 4,411,985.

The antifoggant which is preferably used in the present invention is an organic halide, and examples thereof include the compounds described in JP-A-50-119624, JP-A-50-120328, JP-A-51-121332, JP-A-54-58022, JP-A-56-70543, JP-A-56-99335, JP-A-59-90842, JP-A-61-129642, JP-A-62-129845, JP-A-6-208191, JP-A-7-5621, JP-A-7-2781, JP-A-8-15809 and U.S. Pat. Nos. 5,340,712, 5,369,000 and 5,464,737.

The antifoggant for use in the present invention may be added in any form of a solution, powder, solid microparticle dispersion and the like. The solid microparticle dispersion is performed using a known pulverization means (e.g., ball mill, vibrating ball mill, sand mill, colloid mill, jet mill, roller mill). At the time of solid microparticle dispersion, a dispersion aid may also be used.

Although not necessary for practicing the present invention, it is advantageous in some cases to add a mercury (II) salt as an antifoggant to the emulsion layer. Preferred mercury (II) salts for this purpose are mercury acetate and mercury bromide. The addition amount of mercury for use in the present invention is preferably from $1\times10^{-9}$ to $1\times10^{-3}$ mol, more preferably from $1\times10^{-6}$ to $1\times10^{-4}$ mol, per mol of silver coated.

The heat developable photosensitive material of the present invention may contain a benzoic acid compound for the purpose of achieving high sensitivity or preventing fog. The benzoic acid compound for use in the present invention may be any benzoic acid derivative, but preferred examples of the structure include the compounds described in U.S. Pat. Nos. 4,784,939 and 4,152,160 and JP-A-9-329863, JP-A-9-329864 and JP-A-9-281637. The benzoic acid compound for use in the present invention may be added to any site of the photosensitive material, but the layer to which the benzoic acid is added is preferably a layer on the surface having the image-forming layer such as a photosensitive layer, more preferably an organic silver salt-containing layer that is the image-forming layer. The benzoic acid compound for use in the present invention may be added at any step during the preparation of the coating solution. In the case of adding the benzoic acid compound to an organic silver salt-containing layer, it may be added at any step from the preparation of the organic silver salt until the preparation of the coating solution, but is preferably added in the period after the preparation of the organic silver salt and immediately before the coating. The benzoic acid compound for use in the present invention may be added in any form of a powder, solution, microparticle dispersion and the like, or may be added as a solution containing a mixture of the benzoic acid compound with other additives such as a sensitizing dye, a reducing agent and a color toner. The benzoic acid compound for use in the present invention may be added in any amount; however, the addition amount thereof is preferably from $1\times10^{-6}$ to 2 mol, more preferably from $1\times10^{-3}$ to 0.5 mol, per mol of silver.

The heat developable photosensitive material of the present invention may contain a mercapto compound, a disulfide compound or a thione compound so as to control the development by inhibiting or accelerating the development or improve the storage stability before or after the development.

In the case of using a mercapto compound in the present invention, any structure may be used but those represented by Ar—SM or Ar—S—S—Ar are preferred, wherein M is a hydrogen atom or an alkali metal atom, and Ar is an aromatic ring or condensed aromatic ring containing one or more nitrogen, sulfur, oxygen, selenium or tellurium atoms, preferably a heteroaromatic ring such as benzimidazole, naphthimidazole, benzothiazole, naphthothiazole, benzoxazole, naphthoxazole, benzoselenazole, benzotellurazole, calbazole, imidazole, oxazole, pyrazole, triazole, thiadiazole, tetrazole, triazine, pyrimidine, pyridazine, pyrazine, pyridine, purine, quinoline and quinazolinone. The heteroaromatic ring may have a substituent selected from, for example, the group consisting of halogen (e.g., Br, Cl), hydroxy, amino, carboxy, alkyl (e.g., alkyl having one or more carbon atoms, preferably from 1 to 4 carbon atoms), and alkoxy (e.g., alkoxy having one or more carbon atoms, preferably from 1 to 4 carbon atoms). Examples of the mercapto substituted heteroaromtic compound include 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobis(benzothiazole), 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4(3H)-quinazolinone, 7-trifluoromethyl-4-quinolinethiol, 2,3,5,6-tetrachloro-4-pyridinethiol, 4-amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methylpyrimidine hydrochloride, 3-mercapto-5-phenyl-1,2,4-triazole, 2-mercapto-4-phenyloxazole, N-[3-(mercaptoacetylamino) propyl] calbazole and the like. However, the present invention is by no means limited thereto.

The amount of the mercapto compound added is preferably from 0.0001 to 1.0 mol, more preferably from 0.001 to 0.3 mol, per mol of silver in an emulsion layer.

The image forming layer (preferably the photosensitive layer) in the present invention may contain a plasticizer or lubricant, and examples thereof include polyhydric alcohols (for example, glycerins and diols described in U.S. Pat. No. 2,960,404), fatty acids or esters described in U.S. Pat. Nos. 2,588,765 and 3,121,060, and silicone resins described in British Patent No. 955,061.

With this invention, it is preferable to form a protection layer on the image forming layer, and as a binder for such a protection layer, it is preferable to use a latex of a polymer having a glass transition temperature of 25° C. or higher and 70° C. or lower as described above. In this situation, it is preferable to use the above polymer latex to form 50% by weight or higher, preferably 70% by weight or higher, of the entire binder of the protection layer. In this invention, at least one layer of such a protection layer is preferably formed. The binder structure, coating method, and the like of such a protection layer are substantially the same as those of the image forming layer. Preferably used as the binder for the protective layer are those based on acrylic compound, styrene, acrylic compound/styrene, vinyl chloride, and vinylidene chloride. Specifically, those of acrylic resin type such as VONCORT R3370, 4280, Nipol Lx857, and methyl methacrylate/2-ethylhexyl (meta)acrylate/hydroxyethyl meth(meta)acrylate/styrene/(meta)acrylic acid copolymers; those of vinyl chloride resin type such as Nipol G576; and those of vinylidene chloride resin type such as Aron D5071 are preferably used.

The entire binder amount for protection layer used for the invention is 0.2 to 5.0 g/m$^2$, more preferably, 0.5 to 4.0 g/m$^2$.

As a surface protection layer of the invention, any adhering prevention material can be used. As an example for an adhering prevention material, exemplified are wax, silica particles, styrene containing elastomeric block copolymer (e.g., styrene-butadiene-styrene, styrene-isoprene-styrene), cellulose acetate, cellulose acetate butyrate, cellulose propionate, and mixtures of those are exemplified. A crosslinking agent for crosslinking and a surfactant for improving coating capability or the like can be added to the image forming layer of the invention.

For the image forming layer of the invention and the protection layer of the image forming layer, a light absorbing substance or a photographic element including a filter dye as described in U.S. Pat. No. 3,253,921, U.S. Pat. No. 2,274,782, U.S. Pat. No. 2,527,583, and U.S. Pat. No. 2,956,879 can be used. Moreover, the dye can be mordanted as described in U.S. Pat. No. 3,282,699. As the use amount of the filter dye, the light absorbing degree at the exposing wavelength is preferably 0.1 to 3, more preferably, 0.2 to 1.5.

The photosensitive layer that is the image-forming layer for use in the present invention may contain a dye or pigment of various types so as to improve the color tone or prevent the irradiation. Any dye or pigment may be used in the photosensitive layer for use in the present invention, and examples thereof include pigments and dyes described in the color index. Specific examples thereof include organic pigments and inorganic pigments such as a pyrazoloazole dye, an anthraquinone dye, an azo dye, an azomethine dye, an oxonol dye, a carbocyanine dye, a styryl dye, a triphenylmethane dye, an indoaniline dye, an indophenol dye and phthalocyanine. Preferred examples of the dye for use in the present invention include anthraquinone dyes (e.g., Compounds 1 to 9 described in JP-A-5-341441, Compounds 3–6 to 3–18 and 3–23 to 3–38 described in JP-A-5-165147), azomethine dyes (e.g., Compounds 17 to 47 described in JP-A-5-341441), indoaniline dyes (e.g., Compounds 11 to 19 described in JP-A-5-289227, Compound 47 described in JP-A-5-341441, Compounds 2–10 and 2–11 described in JP-A-5-165147) and azo dyes (Compounds 10 to 16 described in JP-A-5-341441). The dye may be added in any form of a solution, emulsified product or solid microparticle dispersion or may be added in the state mordanted with a polymer mordant. The amount of such a compound used may be determined according to the objective amount absorbed but, in general, the compound is preferably used in an amount of from $1\times10^{-6}$ to 1 g per square meter of the sensitive material.

The heat developable photosensitive material according to the invention is preferably a so-called one side photosensitive material having a photosensitive layer containing at least one layer of silver halide emulsion on one side of the support, and a back layer on the other side.

With this invention, the back layer preferably has a maximum absorption in a prescribed range of about 0.3 or higher and 2.0 or lower. If the prescribed range is 750 to 1,400 nm, it is preferable that the optical density is equal to or greater than 0.005 and less than 0.5 in a range of 750 to 360 nm, more preferably, that it is an antihalation layer having an optical density equal to or greater than 0.001 and less than 0.3. When the prescribed range is 750 nm or less, the antihalation layer preferably has a maximum absorption equal to or greater than 0.3 less than 2.0 before image forming in the prescribed range and an optical density equal to or greater than 0.001 and less than 0.3 after image forming in the range of 750 to 360 nm. There is no special limitation to a method for lowering the optical density down to the above range after forming images, and exemplified are a method lowering dye density by eliminating colors from heating as described in Belgian Patent No. 733,706, a method for lowering density by eliminating colors from light radiation as set forth in JP-A-54-17,833, and the like.

In the case when an antihalation dye is used in the present invention, the dye may be any compound so long as the compound has an objective absorption in the desired wavelength region, the absorption in the visible region can be sufficiently reduced after the processing, and the antihalation layer can have a preferred absorption spectrum form. While examples thereof include those described in the following patent publications, the present invention is by no means limited thereto: as a single dye, the compounds described in JP-A-59-56458, JP-A-2-216140, JP-A-7-13295, JP-A-7-11432, U.S. Pat. No. 5,380,635, JP-A-2-68539 (from page 13, left lower column, line 1 to page 14, left lower column, line 9) and JP-A-3-24539 (from page 14, left lower column to page 16, right lower column); and as a dye which is decolored after the processing, the compounds described in JP-A-52-139136, JP-A-53-132334, JP-A-56-501480, JP-A-57-16060, JP-A-57-68831, JP-A-57-101835, JP-A-59-182436, JP-A-7-36145, JP-A-7-199409, JP-B-48-33692, JP-A-B-50-16648, JP-B-2-41734 and U.S. Pat. Nos. 4,088,497, 4,283,487, 4,548,896 and 5,187,049.

In this invention, the suitable binder for back layer is transparent or semitransparent, and generally colorless and can be a natural polymer, synthetic resin polymer or copolymer, and other media for forming films, such as: gelatin, Arabic rubber, poly(vinyl alcohol), hydroxyethylcellulose, cellulose acetate, cellulose acetate butyrate, poly(vinylprrolidone), casein, starch, poly(acrylic acid), poly(methymethacrylic acid), poly(vinyl chloride), poly(methacrylic acid), copoly(styrene-maleic anhydride), copoly(styrene-acrylonitrile), copoly(styrene-butadiene), poly(vinyl acetal) group such as poly(vinyl formal) and poly(vinyl butyral), poly (ester) group, poly(urethane) group, phenoxy resin, poly (vinylidene chloride), poly (epoxide), poly(carbonate) group, poly(vinyl acetate), cellulose ester group, poly(amide) group. The binder can be covered with water, organic solvent, or emulsion.

In the one side photosensitive material according to the invention, a matting agent can be added to a surface protection layer of a photosensitive emulsion layer and/or a back layer or a surface protection layer of a back layer to improve the conveyance property. The matting agent is fine particles of organic or inorganic compounds, which are generally water-insoluble. Arbitrary agents as a matting agent can be used, such as well-known in the art, e.g., organic matting agents described in specifications of U.S. Pat. No. 1,939,213, U.S. Pat. No. 2,701,245, U.S. Pat. No. 2,322,037, U.S. Pat. No. 3,262,782, U.S. Pat. No. 3,539,344, and U.S. Pat. No. 3,767,448, and inorganic agents described in specifications of U.S. Pat. No. 1,260,772, U.S. Pat. No. 2,192,241, U.S. Pat. No. 3,257,206, U.S. Pat. No. 3,370,951, U.S. Pat. No. 3,523,022, U.S. Pat. No. 3,769,020. For example, as examples of an organic compound that can be used as a matting agent, specifically, preferably used are: as a water-dispersing vinyl polymer, polymethylacrylate, polymethylmethacrylate, polyacrylonitrile, acrylonitrile-α-methylstyrene, polystyrene, styrene-divinylbenzene copolymer, polyvinyl acetate, polyethylene carbonate, polytetrafluoroethylene, and the like, as a cellulose derivative, methylcellulose, cellulose acetate, cellulose acetate propionate, and the like, as a starch derivative, carboxystarch, carboxynitrophenylstarch, urea-formaldehyde-starch reactant, and the like, as hardened gelatin in use of a known hardening agent, and hardened gelatin of micro capsule hollow particles upon coacervation hardening. As examples of inorganic compounds, silicon dioxide, titanium dioxide, magnesium dioxide, aluminum oxide, barium sulfate, calcium carbonate, sliver chloride that is made less sensitive by a known method, silver bromide of the same, glass, and diatomite can be used preferably. The matting agent can be used according to the necessity in mixing substances of different kinds. There is no special limitation on the size and shape of the matting agent, and the agent of any grain size can be used. It is preferable to use the grain size of 0.1 micron to 30 microns when this invention is implemented. The grain size profile of the matting agent can be narrow and wide. On the other hand, because the matting agent greatly affects the haze and surface luster of the sensitive material, it is preferable to design the grain size, the shape, and the grain size profile meeting to the condition corresponding to the necessity at a time of production of the matting agent or by mixing of plural matting agents.

It is a preferable embodiment that the matting agent is added to the back layer in this invention, and as a mat degree of the back layer the Beck smoothness is preferably 1200 sec or less and 10 sec or more, and more preferably 700 sec or less and 50 sec or more.

In this invention, the matting agent is preferably contained in an outmost surface layer of the photosensitive material, a layer functioning as an outmost surface layer, and a layer closer to the external surface and preferably contained on a layer functioning as a so-called protection layer. The mat degree of the emulsion surface protection layer can be any one as far as the stardust problem does not occur, and it is preferable that the Beck smoothness is 500 sec or more and 10000 sec or less, and particularly, 500 sec or more and 2000 sec or less.

The heat developable photographic emulsion used in this invention is structured of a single or more layers on the support. The structure of a single layer includes the organic silver salt, the silver halide, the developing agent, and the binder, and desired additional materials such as color adjuster, covering aid, and other aids. The structure of two layers includes the organic silver salt and the silver halide in the first emulsion layer (ordinarily a layer adjacent to the base), and some other components should be included in the second layer or both layers. However, a two layer structure is conceivable in which the entire components are contained in the sole emulsion layer and in which a protection layer is contained. The structure of multicolor photosensitive heat developable photographic material may contain a component of those two layers for each color, and a single layer may contain all components as set forth in U.S. Pat. No. 4,708,928. In the case of multi-dye multicolor photosensitive heat developable photographic material, each emulsion layer may held generally in being distinctive from one another by using functional or non-functional barrier layers between the respective photosensitive layers as set forth in U.S. Pat. No. 4,460,681.

A backside resistive heating layer described in U.S. Pat. Nos. 4,460,681 and 4,374,921 may also be used in the photosensitive heat-developable photographic image system.

A film hardening agent may be used for respective layers such as the image forming layer (preferably, photosensitive layer), the protection layer, and the back layer. As an example for the film hardening agent, exemplified are polyisocyanate groups as set forth in U.S. Pat. No. 4,281,060, JP-A-6-208,193, and the like, epoxy compound groups as set forth in U.S. Pat. No. 4,791,042 and the like, vinylsulfone based compound groups as set forth in JP-A-62-89048, and the like.

A surfactant can be used in this invention for improving the coating property, and the electrostatic property, and the like. As examples of the surfactant, any proper materials, such as nonion based, anion based, cation based, fluorine based and the like can be used. More specifically, exemplified are fluorine based polymer surfactants as set forth in JP-A-62-170,950, U.S. Pat. No. 5,380,644, and the like, fluorine based surfactants as set forth in JP-A-60-244,945, JP-A-63-188,135, and the like, polysiloxane based surfactants as set forth in U.S. Pat. No. 3,885,965, and the like, polyalkileneoxide as set forth in JP-A-6-301,140, anion based surfactants, and so on.

The photographic emulsion for heat-development of the invention can be generally covered on various kinds of support. Typical supports comprise polyester film, undercoating polyester film, poly(polyethylene terephthalate) film, polyethylene naphthalate film, cellulose nitrate film, cellulose ester film, poly(vinylacetal) film, polycarbonate film, and related or resin like materials, and include glass, paper, metal and so on. Also typically used are flexible supports, particularly, a paper support coated by a polymer such as partially acetified, or baryta and/or α-olefin polymer, particularly, α-olefin polymer having 2 to 10 carbon atoms such as polyethylene, polypropylene, ethylene-butene copolymer, and the like. The support can be transparent or not transparent, but the preferable support is transparent. Among these, biaxially stretched polyethylene terephthalate (PET) to about 75 to 200 microns is preferred.

On the other hand, if a plastic film is passed through a heat developing apparatus for heat processing done at 80° C., the film generally is contracted in size. When the material after the processing is used for printing platemaking purpose, this contraction raises a serious problem when a precise multicolor printing is done. Therefore, in this invention, it is preferable to use a film having a small size change in which inner stresses remaining in the film are relaxed during biaxially stretching to eliminate thermal contraction stresses occurring during the heat development. For example, a polyethylene terephthalate or the like can be used preferably which is thermally treated at a temperature of 100° C. to 210° C. before the photographic emulsion for heat development is coated. Also films having a higher glass transition temperature are preferable, and polyetherethyleketone, polystyrene, polysulfone, polyethersulfone, polyacrylate, polycarbonate, and the like can be used.

The heat developable photosensitive material according to the invention may include a layer containing, e.g., soluble salts (e.g., choloride, nitrate, etc.), evaporated metal layer, ionic polymers as set forth in U.S. Pat. No. 2,861,056 and U.S. Pat. No. 3,206,312, insoluble inorganic salts as set forth in U.S. Pat. No. 3,428,451, tin oxide as set forth in JP-A-60-252,349, and JP-A-57-104,931, and so on.

As a method for obtaining color images using the heat developable photosensitive materials of the invention, there is a method as set forth in JP-A-7-13,295, 10 page left column 43 line to 11 page left column line 40. As a stabilizer for color dying images, exemplified are British Patent No. 1,326,889, U.S. Pat. Nos. 3,432,300, 3,698,909, 3,574,627, 3,573,050, 3,764,337 and 4,042,394.

The heat developable photographic emulsion of the invention can be coated by various coating operations such as a dipping coating, a air knife coating, flow coating, and extrusion coating using a hopper as set forth in U.S. Pat. No. 2,681,294. Two or more layers, if desired, can be covered at the same time by a method as set forth in U.S. Pat. No. 2,761,791, and British Patent No. 837,095.

The heat developable photographic material of the invention may contain additional layers, for example, a dye reception layer for receiving movable dye images, non-transparent layer used when a reverse printing is made, a protection top coating layer, primer layers already known in the art of light heat photographic technology, and so on. The sensitive material of the invention preferably can form images with the single sheet only, and it is preferable that the functional layers necessary for forming images such as an image receiving layer or the like are not in another sensitive material.

An exposing apparatus used for imagewise exposure of the invention can be any apparatus capable of making exposure of 10 to 7 seconds or less, and in general, a preferable exposing apparatus uses as a light source an LD (Laser Diode), an LED (Light Emitting Diode). Particularly, the LD is preferable in terms of high output and high resolution. Those light sources can be any thing capable of generating light having an electromagnetic wave spectrum of a targeted wavelength range. For example, as LDs, a dye laser, gas laser, solid laser, semiconductor laser or the like can be used.

Exposure of the invention means that the light beams of a light source are overlapped to make an exposure, and overlapping here indicates the pitch width of the subscanning is smaller than a beam diameter. Overlap can be expressed in a quantitative manner with FWHM divided by subscanning pitch width (overlap coefficient) where the beam diameter is represented with a full width at half maximum (FWHM) of a beam intensity. In this invention, the overlap coefficient is preferably 0.2 or higher.

The scanning method of a light source of the exposing apparatus used in this invention is not limited, and any of a cylindrical outer surface scanning method, a cylindrical inner surface scanning method, a plane scanning method, and the like can be used. The channel of a light source can be either a single channel or multiple channels, and in the case of the cylindrical outer surface method, the multiple channels can be used preferably.

The heat developable photosensitive material of the present invention has a low haze at the exposure and is liable to incur generation of interference fringes. For preventing the generation of interference fringes, a technique of entering a laser ray obliquely with respect to the image-recording material disclosed in JP-A-5-113548 and a method of using a multimode laser disclosed in International Patent Publication WO95/31754 are known and these techniques are preferably used.

While the heat developing process when the images are formed in use of the heat developable photosensitive material of the present invention may be a development method by any method, development is usually performed by elevating the temperature of the photosensitive material after the imagewise exposure. As a favorable embodiment of a used heat developing machine, heat developing machines set forth in Japanese Patent Publication (hereinafter referred to as "JP-B-") Heisei No. 5-56,499, Japanese Patent No. 684453, JP-A-9-292,695, JP-A-9-297,385, and International Patent WO No. 95/30934 as types in which the heat developable photosensitive material is in contact with a heat source such as a heat roller and a heat drum, heat developing machines set forth in JP-B-7-13,294, International Patent Nos. WO 97/28489, WO 97/28488, and WO 97/28487 as non-contact types are exemplified. A more preferable embodiment is a non-contact type heat developing machine. A preferable development temperature is from 80 to 250° C., more preferably from 100 to 140° C. The development time is preferably from 1 to 180 seconds, more preferably from 10 to 90 seconds.

As a method for preventing processing uneveness due to size deviations during heat development of the heat developable photosensitive material of the invention, a method for forming images (so called multistage heating method) by heat development at a temperature of 110° C. or higher and 140° C. or less after so heating five seconds or longer at a temperature of 80° C. or higher and less than 115° C. as not to create images is effective.

FIG. 1 shows a structural example off a heat developing machine used for heat developing process of the heat developable photosensitive material of the invention. FIG. 1 shows a side view of the heat developing machine. The heat developing machine shown in FIG. 1 includes a feeding roller pair 11 (lower roller is the heating roller) for feeding the heat developable photosensitive material 10 in a plane manner in correcting and preheating the material 10 into a heating section and another feeding roller pair 12 for feeding the heat developable photosensitive material 10 in a plane manner in correcting the material 10 after heat development. The heat developable photosensitive material 10 is subject to heat development during feeding from the feeding roller pair 11 to the feeding roller pair 12. A conveying means for conveying the heat developable photosensitive material 10 during the heat development has a plurality of rollers 13 on a side with which a surface having the image forming layer is in contact with a smooth surface 14 to which a nonwoven fabric (e.g., polyphenylene sulfate, Teflon) or the like is adhered on a side where the back surface in opposition to the above side is in contact. The heat developable photosensitive material 10 is conveyed by drive of the plural rollers 13 in contact with the surface having the image forming layer where the back surface slides on the smooth surface 14. As a heating means, heaters 15 are installed over the rollers 13 and below the smooth surface 14 so that the double sides of the heat developable photosensitive material 10 is heated. As a heating means in this situation, panel heaters and the like are exemplified. The clearance between the rollers 13 and the smooth surface 14 may vary depending on the member of the smooth surface but is adjusted to a certain clearance capable of feeding the heat developable photosensitive material 10. It is preferably 0 to 1 mm.

The material of the surface of each roller 13 and the member of the smooth surface 14 can be any material as far as durable at a high temperature and not raising any problem to feed the heat developable photosensitive material 10. The material of the roller surface is preferably silicone rubber, and the member of the smooth surface is preferably of a nonwoven fabric made of a polyphenylenesulfate (PPS) or Teflon (PTFE). As a heating means, plural heaters are used, and each preferably is controlled to set freely its heating temperature.

Although the heating section is constituted of a preheating section A having the feeding roller pair 11 and a heat developing processing portion B having the heaters 15, the preheating portion A located on an upstream side of the heat developable processing section B is preferably set at a temperature lower than the heat developing temperature (e.g., about 10 to 30° C. lower) but adequate for vaporizing moistures in the heat developable photosensitive materials 10 as well as time, and more preferably, the heat developable processing section 3 is set at a temperature higher than the glass transition temperature (Tg) of the support of the heat developable photosensitive material 10 as not to create unevenness in development.

A guide plate 16 is disposed on a downstream side of the heat developing processing section B, and a slowly cooling section C is also disposed. The guide plate 16 is preferably made of a material having a low heat conducting rate, and cooling preferably is done gradually.

The machine is illustrated according to the illustrated example, but the heat developing machine is not limited to this, and the heat developing machine used in this invention can have various structures as set forth in, e.g., JP-A-7-13, 294, In the case of the multistage heating method used preferably in this invention, with the above apparatus or the like, two or more heat sources having different heating temperatures are installed, and they are heated at different temperatures continuously.

EXAMPLES

Hereinafter, the advantages of the invention are illustrated with the embodiments below, but this invention is not limited to those.

Example 1

(Preparation of Silver Halide Emulsion (Emulsion A)

Into 700 ml of water, 11 g of alkali-processed gelatin as set forth in Table 1 (during particle formation), 30 mg of potassium bromide, and 1.24 g of sodium 4-methyl benzene sulfonate were dissolved, and after adjusting the pH to 6.5 at a temperature of 40° C., 159 ml of an aqueous solution containing 18.6 g of silver nitrate and an aqueous solution containing 1 mol/l of potassium bromide, $5\times10^{-6}$ mol/l of $(NH_4)_2RhCl_5(H_2O)$, and $2\times10^{-5}$ mol/l of $K_3IrCl_6$ were added by the control double jet method over 6 minutes and 30 seconds while keeping the pAg at 7.7. Subsequently, 476 ml of an aqueous solution containing 5.5 g of silver nitrate and an aqueous halogen salt solution containing 1 mol/l of potassium bromide and $2\times10^{-5}$ mol/l of $K_3IrCl_6$ were added by the control double jet method over 28 minutes and 30 seconds while keeping the pAg at 7.7. Thereafter, desalting processing was made where the pH was lowered to cause coagulation precipitation, and then 0.17 g of Compound A and an alkali-processed gelatin (during dispersion) produced by an enzyme decomposition as set forth in Table 1 and an adding amount (g) were added to adjust the material to have the pAg at 7.9 with the pH 5.9. The obtained particles had a mean particle size of 0.08 micron, a coefficient of variation of the projected area of 9%, and a (100) face ratio of 90% and were cubic particles.

The silver halide particles thus obtained was warmed to 60° C. and added with sodium benzene thiosulfonate in an amount of 76 micron mol per mol of silver, and after 3 minutes, sodium thiosulfate of 71 microns was added, ripened for 100 minutes, it was cooled to 40° C. after adding 4-hydroxy-6-methyl-1,3,3a,7-tetrazaindene of $5\times10^{-4}$ mol.

Subsequently, it was kept at 40° C., added with $12.8\times10^{-4}$ mol of the below sensitizing dye A and the compound B of $6.4\times10^{-3}$ mol in stirring those. After rapidly cooling it after 20 minutes, the preparation of silver halide emulsion was finished.

Sensitizing Dye A

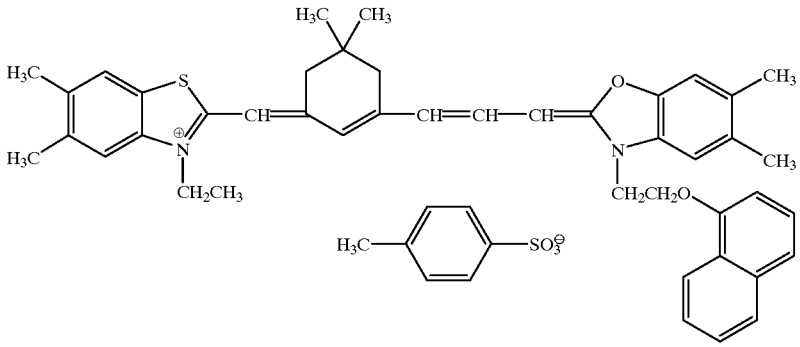

Compound A

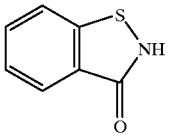

Compound B

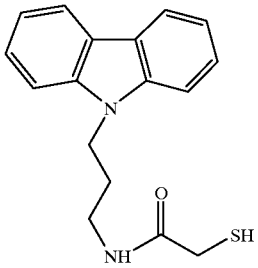

(Preparation of organic silver salt dispersion)

<Organic acid silver A>

87.6 g of behenic acid made of Henkel (product name Edenor C22-85R), 423 ml of a distilled water, 49.2 ml of 5N—NaOH solution, and 120 ml of tert-butyl alcohol were mixed to obtain a sodium behenic acid solution by stirring the mixture at 75° C. for one hour to be reacted. Separately, 206.2 ml of an aqueous solution of 40.4 g of silver nitrate was prepared and kept at a temperature of 10° C. A reaction container in which 635 ml of the distilled water and 30 ml of the tert-butyl alcohol were placed was kept at a temperature of 30° C., to which the above sodium behenic acid solution of the entire amount and the silver nitrate aqueous solution of the entire amount were added at a constant flow rate for 62 minutes 10 seconds and 60 minutes, respectively, while stirred. At that time, for 7 minutes 20 seconds after beginning of addition of the silver nitrate aqueous solution, only the silver nitrate aqueous solution was added; subsequently, the sodium behenic acid solution start to be added; and for 9 minutes 30 seconds after addition of the silver nitrate aqueous solution, only the sodium behenic acid solution was added. During this processing, the temperature inside the reaction container was kept at 30° C., and the solution was controlled as not to raise the liquid temperature. The piping system for addition of the sodium behenic acid solution was to keep the temperature by a steam trace and to control the steam amount so that the liquid temperature at the outlet of the addition nozzle tip became 75° C. The piping system for addition of the sodium silver nitrate was to keep the temperature by circulating cool water outside a double pipe. The addition position of the sodium behenic acid solution and the addition position of the sodium silver nitrate were located symmetrically with respect to a stirring axis as a center, and were adjusted to be at a level not to contact with the reactive composition.

After the completion of addition of the sodium behenic acid solution, the solution was stirred for twenty minutes at a temperature as it was and left over to decrease the temperature to 25° C. Subsequently, the solid content was separated by suction filtration, and the solid content was washed with water until the conductivity of the filtered water became 30 $\mu$S/cm. The solid content obtained as described above was preserved as a wet cake without being dried.

Where conditions of the particles of thus obtained behenic acid silver was evaluated with an electronic microscope photography, the crystals were in a scale shape, having an average projection area size of 0.52 micron, an average particle thickness of 0.14 micron, and coefficient of variation of the average sphere corresponding diameter of 15%.

A dispersion of the behenic acid silver was produced according to the following method. A polyvinyl alcohol (goods name: PVA-277, average polymerization degree of about 1700) of 7.4 g and water were added to the wet cake corresponding to 100 g of dried solid portion, and it was adjusted to be 385 g as the whole weight and then preliminarily dispersed at a homo mixer. Then, the original liquid already preliminarily dispersed was treated three times where the pressure of the dispersing machine (goods name: Microfluidizer M-110S-EH, Microfluidics International Corporation made, with G10Z interaction chamber) is adjusted to 1750 kg/m$^2$ and handled three times to obtain the behenic acid silver dispersion. The cooling control is made by attaching the meander type heat exchangers in the front of and at the rear of the interaction chamber, and the desired dispersion temperature was set by adjusting the temperature of the coolant.

Thus obtained behenic acid silver particles contained in the behenic acid silver dispersion were particles having the average projection area size of 0.52 micron, and coefficient of variation of the average sphere corresponding diameter of 15%. The measurement of the particle size was made by Master Sizer X made of Malvern Instruments Ltd. Where evaluation was made by the electronic microscope photography, the particles had the ratio of the major axis to minor axis of 1.5, the particle thickness of 0.14 micron, and the average aspect ratio (ratio of the circle corresponding diameter of the projected area of the particles to particle thickness of 5.1.

(Preparation of reducing agent solid fine particle dispersion of 1,1-bis(2-hydroxy-3,5-dimethylphenyl)-3,5,5-trimethylhexane)

To 25 g of 1,1-bis(2-hydroxy-3,5-dimethylphenyl)-3,5,5-trimethylhexane, 25 g of a 20 wt % water solution of MP-203 of MP polymer, made by Kuraray K.K., 0.1 g of Safinol 104E, Nisshin Kagaku K.K. made, 2 g of methanol, and 48 g of water were added and sufficiently stirred to form a slurry. The slurry was left for three hours. Subsequently, the slurry was introduced into a vessel together with 360 g of zirconia beads, and dispersed in a dispersing machine (1/4G Sand Grinder Mill, Imex Co., Ltd.) for 3 hours to prepare a reducing agent solid fine particle dispersion. The particle size was 0.3 micron or larger and 1.0 micron or less with 80% by weight of particles.

(Preparation of solid fine particle dispersion of polyhalogen compound)

To 30 g of a polyhalogen compound A, 4 g of MP-203 of MP polymer made by Kuraray K.K., 0.25 g of compound C, and 66 g of water were added and sufficiently stirred. Subsequently, the slurry was introduced into a vessel together with 200 g of zirconia beads of 0.5 mm, and dispersed in a dispersing machine (1/16G Sand Grinder Mill, Imex Co., Ltd.) for 5 hours to prepare a solid fine particle dispersion. The particle size was 0.3 micron or larger and 1.0 micron or less with 80% by weight of particles.

With respect to polyhalogen compound B, a solid fine particle dispersion was prepared in substantially the same way as the polyhalogen compound A, and particle size substantially the same was obtained.

(Preparation of solid fine particle dispersion of nucleation agent)

To 10 g of a nucleation agent C-62, 2.5 g of a polyvinyl alcohol (PVA-217, made by Kuraray K.K.), and 87.5 g of water were added and sufficiently stirred to form a slurry. The slurry was left for three hours. Subsequently, the slurry was introduced into a vessel together with 240 g of zirconia beads of 0.5 mm, and dispersed in a dispersing machine (1/14G Sand Grinder Mill, Imex Co., Ltd.) for 10 hours to prepare a solid fine particle dispersion. The particle size was 0.1 micron or larger and 1.0 micron or less with 80% by weight of particles, and the average particle size was 0.5 micron.

(Preparation of solid fine particle dispersion of polyhalogen compound of compound Z)

To 30 g of compound Z, 3 g of MP-203 of MP polymer made by Kuraray K.K., and 87 ml of water were added and sufficiently stirred. The slurry was left for three hours. Subsequently, the slurry was treated in substantially the same manner as preparation of the reducing agent solid fine particle dispersion to prepare a solid fine particle dispersion of the compound Z. The particle size was 0.3 micron or larger and 1.0 micron or less with 80% by weight of particles.

(Preparation of coating solution for emulsion layer)

To silver 1 mol of the thus produced organic silver salt fine particle dispersant, the following binders, materials, and a silver halide emulsion A are added, and adding water, an emulsion layer coating composition was formed.

Binder; LACSTAR3307B as a solid portion, 397 g (Dainippon Ink & Chemicals, Inc., SBR latex, glass transition temperature Tg=17° C.)

| | |
|---|---|
| 1,1-bis(2-hydroxy-3,5-dimethylphenyl)-3,5,5-trimethylhexane as a solid portion, | 149 g |
| polyhalogen compound A as a solid portion, | 34.8 g |
| polyhalogen compound B as a solid portion, | 9.0 g |
| sodium ethylthiosulfate | 0.30 g |
| benzotriazole | 1.04 g |
| polyvinyl alcohol (PVA-235 (Kuraray K. K.)) | 10.8 g |
| 6-iso-propylephthalazin | 15.0 g |
| orth-sodium dihydrogen phosphate, dihydrate | 0.37 g |
| compound Z as a solid portion, | 9.7 g |
| nucleation agent C-62 as a solid portion, | 16.7 g |
| dye A coating amount such that the optical density of 783 nm is 0.3 (typically 0.37 g) | |
| silver halide emulsion as set forth in Table 1 0.06 mol as Ag amount | |

Polyhalogen Compound A

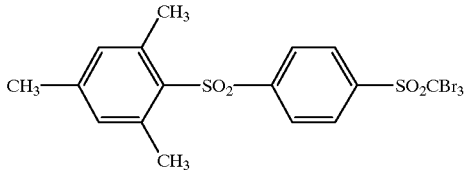

Polyhalogen Compound B

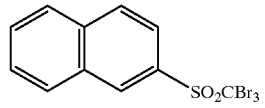

Compound Z

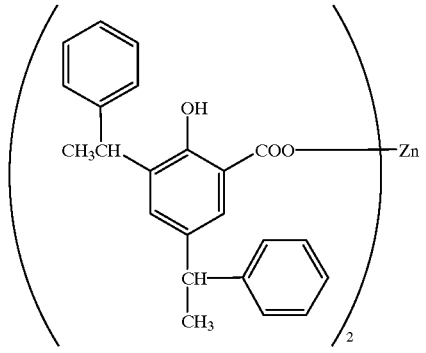

Dye A

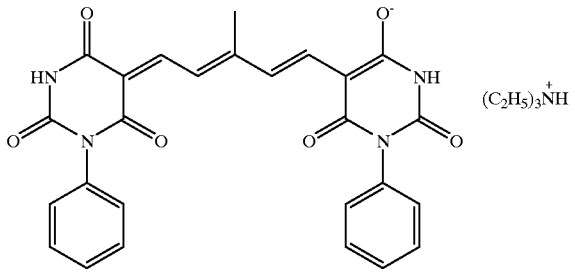

Compound C

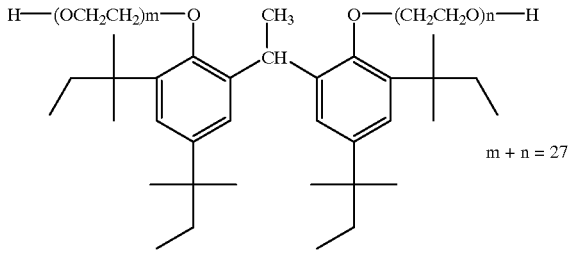

(Preparation of coating composition for emulsion surface lower protection layer)

$H_2O$ was added to 956 g of a polymer latex of methyl methacrylate/styrene/2-ethylhexyl acrylate/2-hydroxyethyl methacrylate/acrylic acid=58.9/8.6/25.4/5.1/2 (wt %), (copolymer; glass transition temperature Tg; 57° C., solid concentration of 21.5%, compound D as a film forming aid; 15 wt %). Subsequently added were Compound E of 1.62 g, a matting agent (polystyrene particle, average particle size 7 microns) of 1.98 g, and polyvinyl alcohol (PVA-235 (Kuraray K.K.)) of 23.6 g. Furthermore, $H_2O$ was added to prepare a coating composition.

(Preparation of coating composition for emulsion surface upper protection layer)

$H_2O$ was added to 630 g of a polymer latex of methyl methacrylate/styrene/2-ethylhexyl acrylate/2-hydroxyethyl methacrylate/acrylic acid=58.9/8.6/25.4/5.1/2 (wt %), (copolymer; glass transition temperature Tg; 54° C. solid concentration of 21.5%, compound D as a film forming aid; 15 wt %), added successively with 30 wt % of carnauba wax (Chukyo Oil and Fat Co., Ltd. Cellosol 524), 0.72 g of Compound E, 7.95 g of Compound F, 1.18 g of a matting agent (polystyrene particles, mean particle size 7 microns), and 8.30 g of polyvinyl alcohol (PVA-235 (Kuraray K.K.)), as well as $H_2O$, thereby preparing the coating composition.

Compound D

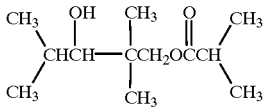

Compound E

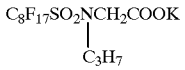

Compound F

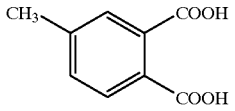

(Production of PET support having back layer/undercoating layer)

(1) Support

Using a terephthalic acid and an ethylene glycol, according to an normal method, a PET of IV (intrinsic viscosity)=66 (measured at 25° C. in phenol/tetrachloroethane=6/4 (ratio by weight)) was obtained. After this was made into pellets, they are dried for four hours at 130° C. After extruded from a T-shape die after melted at 300° C., the material was rapidly cooled, and non-drawn film was produced with a thickness such that the film thickness after getting thermal stability was 120 microns.

This film was longitudinally drawn 3.3 times using rollers having different peripheral speeds from one another and transversely drawn 4.5 times using a tenter. At that time, the temperatures are 110° C. and 130° C., respectively. Then, 4% relaxation was made in the transverse direction at the temperature of 240° C. after thermally stabilizing the film at the same temperature for 20 seconds. Subsequently, the chuck of the tenter was released, the both edges of the film were knurled, and the film was rolled at 4.8 kg/cm$^2$. Thus, a roll was obtained with a width of 2.4 m, a length of 3,500 m, and a thickness of 120 microns.

| | |
|---|---|
| (2) Undercoating layer (a) | |
| Polymer latex (1) [latex of a polymer, which is of a core and shell type in which the core portion is 90 wt % and the shell portion is 10 wt %; the core portion is made of vinylidene chloride/methylacrylate/methylmethacrylate/acrylonitrile/acrylic acid = 93/3/3/0.9/0.1 (wt %); shell portion is made of vinylidene chloride/methlacrylate/methylmethacrylate/acrylonitrile/acrylic acid = 88/3/3/3/3 (wt %), having an average molecular weight amount of 38000] as a solid portion, | 3.0 g/m$^2$ |
| 2,4-Dichloro-6-hydroxy-s-triazine | 23 mg/m$^2$ |
| Matting agent (polystyrene, average diameter; 2.4 $\mu$m) | 1.5 mg/m$^2$ |
| (3) Undercoat layer (b) | |
| Deionized gelatin ($Ca^{2+}$ content; 0.6 ppm, jelly strength; 230 g) | 50 g/m$^2$ |
| (4) Electroconductive layer | |
| Julimer ET-410 (Nihon Junyaku Co., Ltd.) | 96 mg/m$^2$ |
| Alkali treated gelatin (molecular weight about 1,000, $Ca^{2+}$ content; 30 ppm) | 42 mg/m$^2$ |
| Deionized gelatin ($Ca^{2+}$ content; 0.6 ppm) | 8 mg/m$^2$ |
| Compound A | 0.2 mg/m$^2$ |
| Polyoxyethylenephenylether | 10 mg/m$^2$ |
| Sumitex Resin M-3 (water-soluble melamine compound, Sumitomo Chemical Industry (K.K.) made) | 18 mg/m$^2$ |
| Dye A coating amount making the optical density of 783 nm 1.2. $SnO_2$/Sb (weight ratio; 9/1, needle shaped fine particles, major/minor axis = 20 to 30, Isihara Sangyo K.K. made) | 160 mg/m$^2$ |
| Matting agent (Polymethyl methacrylate, average particle size; 5 $\mu$m) | 7 mg/m$^2$ |
| (5) Protection layer | |
| Polymer latex (2) (methyl methacrylate/styrene/2-ethylhexyl acrylate/2-hydroxyethyl methacrylate/acrylic acid = 59/9/26/5/1 (wt %, copolymer)) | 1000 mg/m$^2$ |
| Polystyrenesulfonate (molecular weight) | 2.6 mg/m$^2$ |
| Cellosol 524 (Chukyo Oil and Fat Co., Ltd.) | 25 mg/m$^2$ |
| Sumitex Resin M-3 (water-soluble melamine compound, Sumitomo Chemical Industry (K.K.) made) | 218 mg/m$^2$ |

(6) Production of PET support having back layer/undercoating layer

The undercoating layer (a) and the undercoating layer (b) were coated sequentially on double sides of the support, and those were dried for four minutes at 180° C. Then, a conductive layer and a protection layer were coated sequentially on the one side over which the undercoating layer (a) and the undercoating layer (b) were coated, and a PET support was produced with back/undercoating layers upon drying at 180° C. for four minutes. The dried thickness of the undercoating layer (a) was 2.0 microns.

(7) Feeding thermal treatment (7-1) Thermal treatment

Thus formed PET support with the back/undercoating layers was placed in a thermal treatment zone extending in a whole length of 200 m set at a temperature of 160° C., and conveyed at a tension of 3 kg/cm$^2$ and feeding speed of 20 m/min.

(7-2) Post thermal treatment

Subsequently to the above thermal treatment, the support was passed through a zone of 40° C. for 15 seconds to make a post thermal treatment, and was wound. The winding tension at that time was 10 kg/cm$^2$.

Compound A

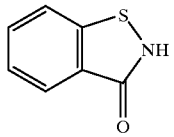

Dye A

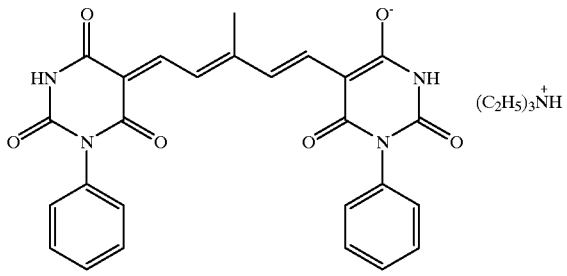

(Preparation of the heat developable photosensitive material (sample))

The above emulsion coating composition was coated as to make the coated sliver amount 1.7 g/m$^2$ on the undercoating layer of the PET support on a side where the undercoating layer (a) and the undercoating layer (b) were coated. An emulsion surface lower protection coating composition was coated simultaneously together with the emulsion coating composition so that the solid coating amount of the polymer latex was 1.31 g/m$^2$. After this, an emulsion surface upper protection coating composition was coated so that the solid coating amount of the polymer latex was 3.02 g/m$^2$ to produce a heat developable photosensitive material. The obtained film surface pH on the image forming side of the heat developable photosensitive material was 4.9; Beck smoothness was 660 seconds; the film surface pH on the opposite side was 5.9; Beck smoothness was 560.

(Evaluation of photographic property)

(Exposing processing)

The obtained heat developable photosensitive material was exposed for $2\times10^{-8}$ using a laser exposing apparatus of a single channel cylindrical inner surface type on which a semiconductor laser is mounted with beam diameter (FWHM, a half of beam intensity) of 12.56 microns, laser output of 50 mW, and output wavelength of 783 nm in adjusting the exposure time by changing the mirror rotary number and the exposure amount by changing the the output value. The overlap coefficient at that time was (Heat development processing)

The exposed heat developable photosensitive material was subject to a heat development processing using the heat developing machine as shown in FIG. 1 for 20 seconds at a temperature of 120° C. at the thermal development processing section as well as for 15 seconds at the preliminary heating section at a temperature of 90 to 100° C. where the roller surface material was a silicon rubber and where the smooth surface was a Teflon non-woven fabric at the heat development processing section. The temperature accuracy in the transverse direction was ±1° C.

(Evaluation of Photographic Performance)

The obtained images were evaluated using a Macbeth TD904 densitometer (visible density). The results were evaluated by Dmin, sensitivity (inverse of ratio of exposure amount giving a higher density by 1.5 than Dmin, the sample No. 1 of the heat developable photosensitive material in Table 4 was set as 100), Dmax, and γ (contrast). The γ was expressed by the gradient of a straight line connecting points of densities 0.2 and 2.5 with each other, where the logarithm of the exposure amount was abscissa.

The results that the above evaluations were made are shown in Table 1 with respect to each heat developable photosensitive material.

TABLE 1

| | silver halide emulsion | | | | | | | |
|---|---|---|---|---|---|---|---|---|
| | gelatin during | gelatin during dispersion | | | | | | |
| sample number | particle formation molecular weight | molecular weight | adding amount | Dmin | Sensitivity | Dmax | ν | remarks |
| 1 | $10\times10^4$ | $10\times10^4$ | 20 g | 0.13 | 100 | 2.8 | 3.2 | comparative example |
| 2 | $10\times10^4$ | $2\times10^4$ | 20 g | 0.11 | 200 | 4.3 | 10 | this invention |
| 3 | $10\times10^4$ | $2\times10^4$ | 51 g | 0.11 | 200 | 4.3 | 10 | this invention |
| 4 | $10\times10^4$ | $2\times10^4$ | 70 g | 0.10 | 180 | 4.3 | 11 | this invention |
| 5 | $2\times10^4$ | $10\times10^4$ | 10 g | 0.12 | 210 | 4 | 9 | this invention |
| 6 | $2\times10^4$ | $2\times10^4$ | 20 g | 0.11 | 240 | 4.1 | 10 | this invention |
| 7 | $2\times10^4$ | $2\times10^4$ | 51 g | 0.11 | 240 | 4.1 | 10 | this invention |
| 8 | $30\times10^4$ | $1\times10^4$ | 51 g | 0.11 | 200 | 4.3 | 11 | this invention |
| 9 | $30\times10^4$ | $10\times10^4$ | 20 g | 0.13 | 100 | 2.5 | 3 | comparative example |
| 10 | $30\times10^4$ | $30\times10^4$ | 20 g | 0.11 | 80 | 2 | — | comparative example |

As for the sample No. 2 to 8, it is turned out that good performance such as low Dmin, high Dmax, and high contrast can be obtained. Therefore, the advantages in the photosensitive silver halide emulsion containing the low molecular weight gelatin are apparent.

Example 2

The coating surface shapes of the sample No. 1 (comparative example) and the sample No. 3 (this invention) in First Embodiment were evaluated. In the sample of the comparative example, 10 pieces of agglutinates occurred per A2 size, but in the sample of the invention, no agglutinate occurred. Accordingly, it is apparent that the heat developable photosensitive material according to the invention may not impair the goods value as a product.

According to the invention, the material is excellent in terms of a high contrast material and provides a good coating surface shape.

What is claimed is:

1. A heat developable photosensitive material having on a support a non-photosensitive silver salt, a photosensitive silver halide emulsion, and a binder, wherein the photosensitive silver halide emulsion comprises a photosensitive silver halide which is formed independently of the non-photosensitive silver salt and a low molecular weight gelatin having a molecular weight of 500 to 60,000.

2. The heat developable photosensitive material according to claim 1, wherein the low molecular weight gelatin has a molecular weight of 1,000 to 40,000.

3. The heat developable photosensitive material according to claim 1, wherein the emulsion is prepared by the method comprising the step of adding the low molecular weight gelatin to a desalted composition containing photosensitive silver halide particles.

4. The heat developable photosensitive material according to claim 3, wherein the emulsion is prepared by the method comprising the steps of preparing silver halide particles in the presence of a gelatin having a molecular weight of more than 60,000, and desalting the resulting composition, and then adding the low molecular weight gelatin to a desalted composition.

5. The heat developable photosensitive material according to claim 1, wherein the emulsion is prepared by the method comprising the step of preparing silver halide particles in the presence of the low molecular weight gelatin.

6. The heat developable photosensitive material according to claim 1, wherein the low molecular weight gelatin is an alkali-processed gelatin, an acid-processed gelatin or a phthalic gelatin.

7. The heat developable photosensitive material according to claim 6, wherein the low molecular weight gelatin is an alkali-processed gelatin.

8. The heat developable photosensitive material according to claim 1, wherein at least 50% by weight of the binder of an image forming layer containing the photosensitive silver halide is a polymer latex having a glass transition temperature of −30° to 40° C.

9. The heat developable photosensitive material according to claim 8, wherein at least 70% by weight of the binder of an image forming layer containing the photosensitive silver halide is a polymer latex having a glass transition temperature of −30° C. to 40° C.

10. The heat developable photosensitive material according to claim 1, which further comprises a nucleation agent.

11. The heat developable photosensitive material according to claim 1, wherein the low molecular weight gelatin is of 50% by weight of more of a dispersion medium.

* * * * *